US010392770B2

(12) United States Patent
Chilton

(10) Patent No.: US 10,392,770 B2
(45) Date of Patent: Aug. 27, 2019

(54) EXCAVATION SUPPORT SYSTEM AND METHODS FOR INSTALLING SAME

(71) Applicant: National Trench Safety, LLC, Houston, TX (US)

(72) Inventor: Ronald W. Chilton, Montgomery, TX (US)

(73) Assignee: NATIONAL TRENCH SAFETY, LLC, Houston, TX (US)

( * ) Notice: Subject to any disclaimer, the term of this patent is extended or adjusted under 35 U.S.C. 154(b) by 0 days.

(21) Appl. No.: 16/193,615

(22) Filed: Nov. 16, 2018

(65) Prior Publication Data

US 2019/0153696 A1 May 23, 2019

Related U.S. Application Data

(60) Provisional application No. 62/589,888, filed on Nov. 22, 2017.

(51) Int. Cl.
*E02D 17/00* (2006.01)
*E02D 17/08* (2006.01)

(52) U.S. Cl.
CPC ..... *E02D 17/08* (2013.01)

(58) Field of Classification Search
CPC ..... E02D 17/04; E02D 17/08; E02D 17/083
See application file for complete search history.

(56) References Cited

U.S. PATENT DOCUMENTS 3,710,578 A 1/1973 Inoue
3,950,952 A * 4/1976 Krings ..... E02D 17/08 405/282
4,376,599 A * 3/1983 Krings ..... E02D 17/08 405/272
4,453,863 A 6/1984 Sutton et al.
4,657,442 A * 4/1987 Krings ..... E02D 17/08 211/182

(Continued)

OTHER PUBLICATIONS

International Search Report and Written Opinion for International Application No. PCT/US2018/061433, dated Feb. 1, 2019.

*Primary Examiner* — Benjamin F Fiorello
(74) *Attorney, Agent, or Firm* — Edmonds & Cmaidalka, P.C.

(57) ABSTRACT

An excavation support system and methods for making same. The system can include a plurality of linear slide-rail posts; a plurality of corner slide-rail posts; at least one slide-rail panel having opposing first and second ends, wherein the first end is disposed within the recessed groove of the linear slide-rail post and the second end is disposed within one of the recessed grooves of the corner slide-rail posts; at least one linear roller cart, having at least one roller attached thereto, adapted to slide onto the linear slide-rail post and secure thereto, the linear roller cart comprising a generally horizontal plate for supporting at least one hydraulic brace leg; and at least one corner roller cart having at least one roller attached thereto, adapted to slide onto the corner slide-rail post and secure thereto. Each cart having a generally horizontal plate for supporting at least one hydraulic brace, and movable in an upward and downward direction relative to the vertical axis of the slide-rail post.

20 Claims, 19 Drawing Sheets

(56) References Cited

U.S. PATENT DOCUMENTS

| | | | | | |
|---|---|---|---|---|---|
| 5,096,334 | A * | 3/1992 | Plank | E02D 17/08 | 405/272 |
| 5,302,054 | A * | 4/1994 | Winkler | E02D 17/08 | 405/272 |
| 5,310,289 | A * | 5/1994 | Hess | E02D 17/08 | 405/272 |
| 5,931,607 | A * | 8/1999 | Hess | E02D 17/08 | 405/272 |
| 6,821,057 | B1 * | 11/2004 | Kadiu | E02D 17/08 | 405/272 |
| 6,848,865 | B2 * | 2/2005 | Kadiu | E02D 17/08 | 405/272 |
| 7,056,068 | B2 * | 6/2006 | Kadiu | E02D 17/08 | 405/272 |
| 7,258,511 | B1 | 8/2007 | Cerda | | |
| 7,883,296 | B2 * | 2/2011 | Meyer | E02D 17/083 | 256/67 |
| 2002/0159844 | A1 | 10/2002 | Meyer | | |
| 2004/0005197 | A1 | 1/2004 | Kadiu | | |
| 2009/0110490 | A1 | 4/2009 | Hess | | |
| 2011/0058903 | A1 * | 3/2011 | Kadiu | E02D 17/08 | 405/272 |

* cited by examiner

EXCAVATION SUPPORT SYSTEM AND METHODS FOR INSTALLING SAME

BACKGROUND

Field

Embodiments of the present invention generally relate to excavation support structures, in particular to the excavation support structures for slide-rail post trench shoring systems.

Description of the Related Art

In the excavation industry, cave-in and trench collapse are common safety hazards associated with open trench excavation methods. In addition to the inherent safety concerns, there are also productivity issues that must be addressed due to the man hour requirements for the installation and removal of the excavation support structure.

Depending upon the project requirements, slide-rail post trench shoring systems may eliminate many of the safety and productivity issues found when using trench shields, tight sheeting, beam and plate systems and wood shoring systems. However, there is still a need for continuous safety and productivity improvements in the industry. More particularly, there is a need for improvements in safety and job efficiency with the vertical mobility of hydraulic braces during installation and removal of slide-rail post trench shoring systems.

SUMMARY

An excavation support system and methods for installing and using same are provided. The system can include a plurality of linear slide-rail posts, each linear slide-rail post having at least one recessed groove formed in a longitudinal axis thereof; a plurality of corner slide-rail posts, each corner slide-rail post having two substantially parallel recessed grooves formed in a longitudinal axis thereof, wherein the two substantially parallel recessed grooves define an angle therebetween; at least one slide-rail panel having opposing first and second ends, wherein the first end is disposed within the recessed groove of the linear slide-rail post and the second end is disposed within one of the recessed grooves of the corner slide-rail posts; at least one linear roller cart, having at least one roller attached thereto, adapted to slide onto the linear slide-rail post and secure thereto, the linear roller cart comprising a generally horizontal plate for supporting at least one hydraulic brace leg, wherein the linear roller cart is movable in an upward and downward direction relative to the vertical axis of the linear slide-rail post without interference from the slide-rail panel; and at least one corner roller cart having at least one roller attached thereto, adapted to slide onto the corner slide-rail post and secure thereto, the corner roller cart comprising a generally horizontal plate for supporting at least one hydraulic brace leg, wherein each corner roller cart is movable in an upward and downward direction relative to the vertical axis of the corner slide-rail post.

A method for installing an excavation support system includes assembling a base structure in a pre-excavation trench, wherein the base structure comprises: a plurality of linear slide-rail posts, each linear slide-rail post having at least one recessed groove formed in a longitudinal axis thereof; a plurality of corner slide-rail posts, each corner slide rail post having two substantially parallel recessed grooves formed in a longitudinal axis thereof, wherein the two substantially parallel recessed grooves define an angle therebetween; a plurality of slide-rail panels having opposing first and second ends, wherein the first end is disposed within one of the recessed grooves of the linear slide-rail posts and the second end is disposed within one of the recessed grooves of the corner slide-rail posts; disposing at least one linear roller cart, having at least one roller attached thereto, onto at least one of the plurality of linear slide-rail posts, wherein the at least one linear roller cart is adapted to slide onto the linear slide-rail post and secure thereto, the linear roller cart comprising a generally horizontal plate for supporting at least one hydraulic brace leg, wherein the linear roller cart is movable in an upward and downward direction relative to the vertical axis of the linear slide-rail; and disposing at least one corner roller cart, having at least one roller attached thereto, onto at least one of the plurality of corner slide-rail posts, wherein the at least one corner roller cart is adapted to slide onto the corner slide-rail post and secure thereto, the corner roller cart comprising a generally horizontal plate for supporting at least one hydraulic brace leg, wherein each corner roller cart is movable in an upward and downward direction relative to the vertical axis of the corner slide-rail post.

BRIEF DESCRIPTION OF THE DRAWINGS

The present disclosure is best understood from the following detailed description when read with the accompanying Figures. It is emphasized that, in accordance with the standard practice in industry, various features are not drawn to scale. In fact, the dimensions of the various features may be arbitrarily increased or reduced for clarity of discussion.

FIG. 18-1 is a cut-out view from FIG. 18, depicting the details of the corner roller cart, according to one or more embodiments provided herein.

DETAILED DESCRIPTION

Figure 1:
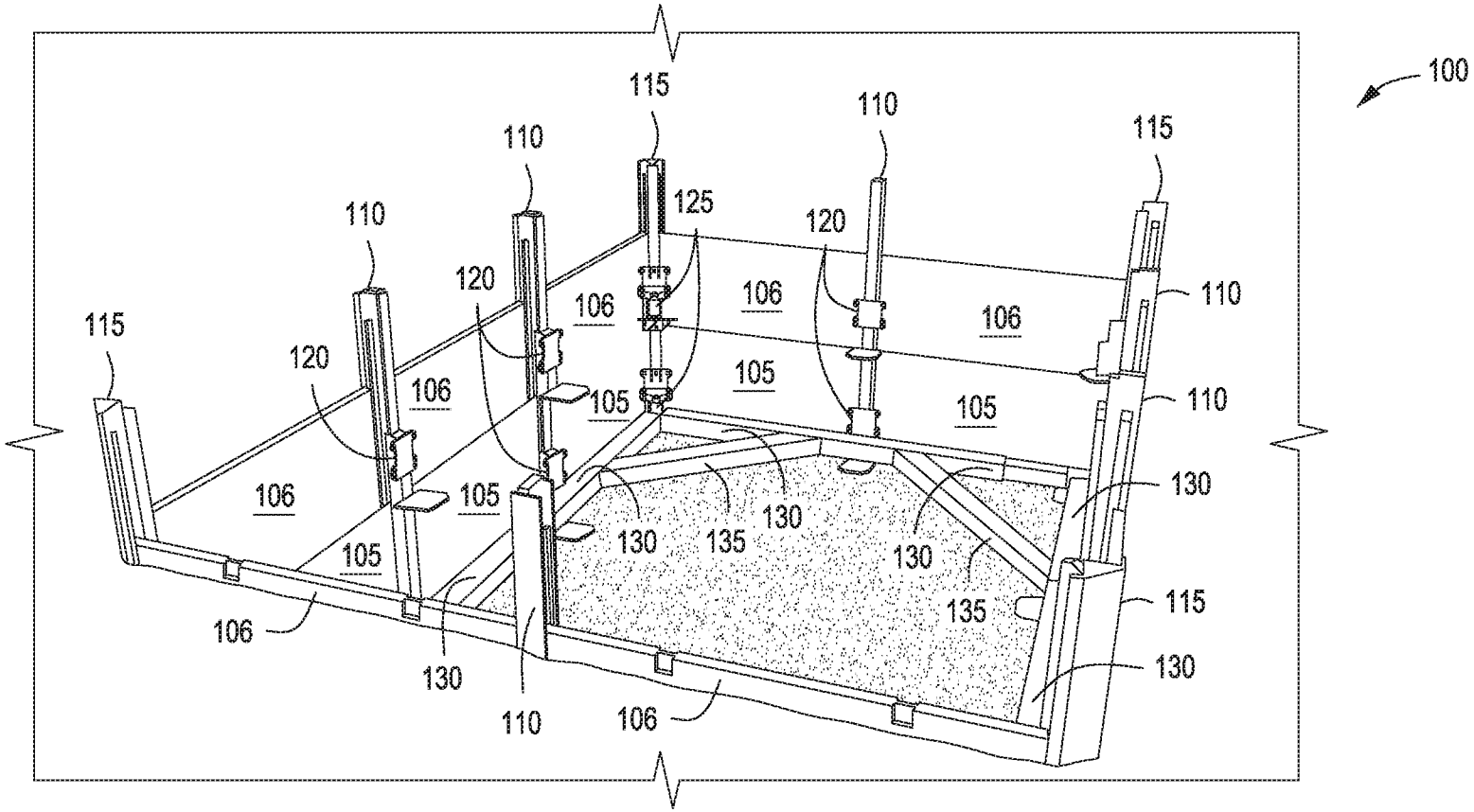
FIG. 1 depicts a top elevation view of an illustrative excavation support system, according to one or more embodiments described herein.

FIG. 1 depicts a top elevation view of an illustrative excavation support system 100, according to one or more embodiments described herein. The excavation support system 100 can include a plurality of linear slide rail posts 110, a plurality of corner slide-rail posts 115, a plurality of slide-rail panels 105, 106, at least one linear roller cart 120, and at least one corner roller cart 125. The shape of the excavation support system 100 can vary. For example, it can be square, rectangular, hexagonal, or any other shape or geometric pattern. For simplicity and ease of description, the excavation support system 100 will be further described with reference to a square structure having two levels of slide-rail panels (lower slide-rail panel 105 and upper slide-rail panel 106) layered one on top of the other. It should be noted that the excavation support system 100 can have multiple levels of slide-rail panels 105, 106, in excess of three or more. The number of levels will depend on the depth of the excavation.

Figure 2:
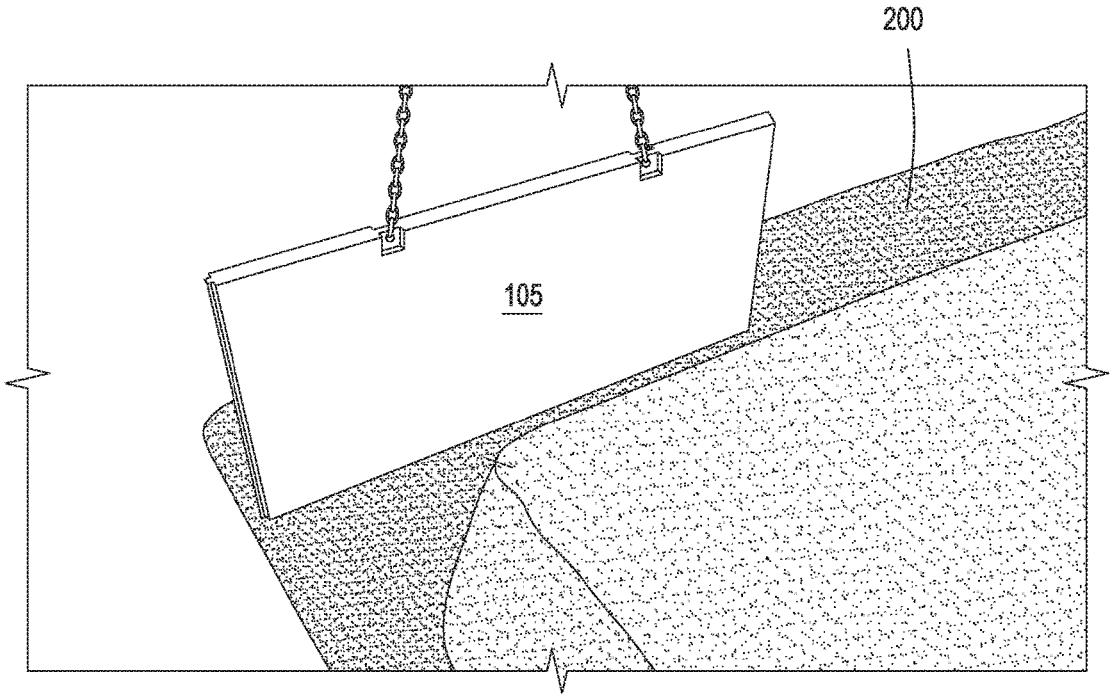
FIG. 2 depicts a front elevation view of an illustrative installation of a slide-rail panel, according to one or more embodiments provided herein.

FIG. 2 depicts a front elevation view of an illustrative slide-rail panel 105, according to one or more embodiments. The slide-rail panel 105, 106 can be a generally flat sheet or plate. The dimensions of the slide-rail panel 105, 106 can vary. For example, the length of the slide-rail panel 105, 106 can range from about 5 feet to about 25 feet, from about 7 feet to about 23 feet, from about 9 feet to about 21 feet, from about 11 feet to about 19 feet, or from about 13 feet to about 17 feet. For example, the length of the slide-rail panel 105, 106 can be up to about 25 feet, up to about 23 feet, up to about 21 feet, up to about 19 feet, or up to about 17 feet. The height of the panel 105, 106 can range from about 3 feet to about 10 feet, from about 4 feet to about 9 feet, from about 5 feet to about 9 feet, or from about 6 feet to about 7 feet. For example the height of the slide-rail panel 105, 106 can be up to about 10 feet, up to about 9 feet, up to about 8 feet, or up to about 7 feet. The thickness of the slide-rail panel 105, 106 can range from about 3 inches to about 12 inches, from about 4 inches to about 11 inches, from about 5 inches to about 10 inches, from about 6 inches to about 9 inches, or from about 7 inches to about 8 inches. For example, the thickness of the slide-rail panel 105, 106 can be up to about 12 inches, up to about 11 inches, up to about 10 inches, up to about 9 inches, or up to about 8 inches.

To make the excavation support system 100, a pre-excavation or preliminary trench 200 can be formed. The shape of the pre-excavation trench 200 can vary. For example, it can be square, rectangular, hexagonal, or any other shape or geometric pattern. In general, the pre-excavation trench 200 can have any shape and dimension that complies with the appropriate safety regulations and the particular soil type at the installation site.

The pre-excavation trench 200 can have a width that is up to about 14 inches, up to about 12 inches, or up to about 10 inches wider than the desired pit dimensions. The pre-excavation or preliminary depth can be about 2 feet to about 8 feet, about 3 feet to about 7 feet, or about 4 feet to about 6 feet in depth. For example, the depth of the pre-excavation trench 200 can be up to about 8 feet, up to about 7 feet, up to about 6 feet, up to about 4 feet, or up to about 3 feet in depth.

After the pre-excavation trench 200 has been formed, a first lower slide-rail panel 105 can be placed inside of the pre-excavation trench 200 so that one side of the slide-rail panel 105 is vertically aligned with one corner of the pre-excavation trench 200. As discussed above, in some embodiments, there can be a lower slide-rail panel 105 and at least one upper slide-rail panel 106. It should be noted that the at least one upper panel 106 can also be referred to as an extension panel 106.

Figure 3:
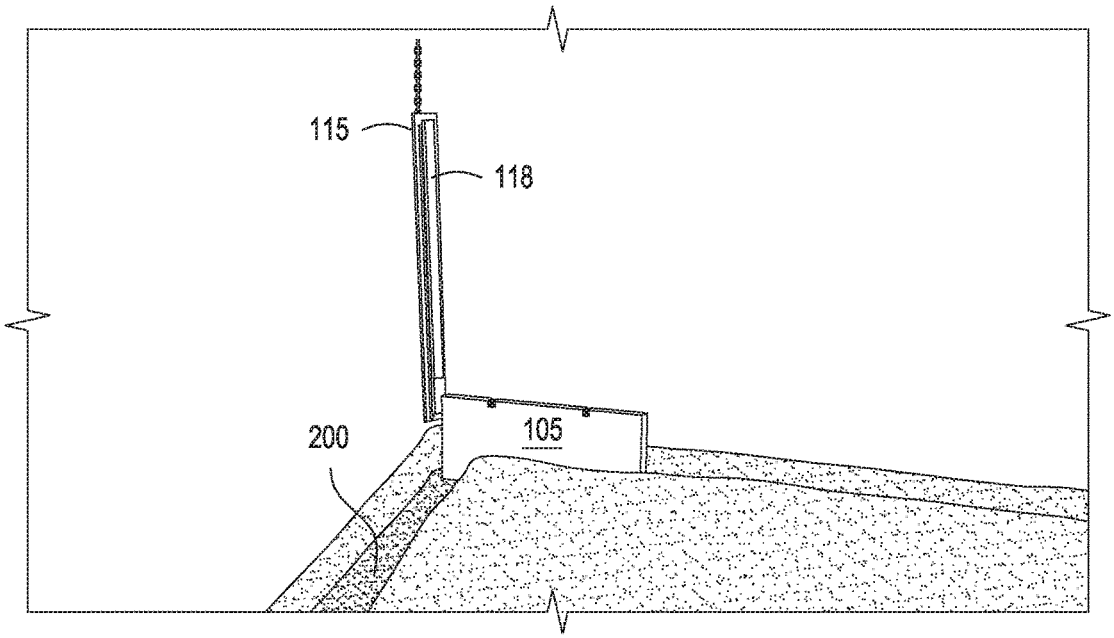
FIG. 3 depicts a front elevation view of one corner of the illustrative excavation system of FIG. 1, with a corner slide-rail post being installed on a first slide-rail panel, according to one or more embodiments provided herein.

FIG. 3 depicts a front elevation view of one corner of the illustrative excavation system 100 of FIG. 1, with a corner slide-rail post 115 being installed on a first slide-rail panel 105, according to one or more embodiments provided herein. The corner slide-rail post 115 can be substantially vertical, and can have at least two generally parallel or generally perpendicular slide-rails 105, 106 threaded or disposed thereon. For example, depending upon the required depth of the excavation structure 100, the corner slide-rail post 115 can have three or more generally parallel slide rails 105 threaded or disposed thereon. Each corner slide-rail post 115 includes at least one vertically oriented recessed groove to provide a guide or track for connecting to one end of a slide-rail panel 105, 106. The corner slide-rail post 115 can have a vertically oriented bracket or faceplate 118 attached about the longitudinal axis of the corner slide-rail post 115. The bracket or faceplate 118 can be configured to extend outward from the corner slide-rail post 115, forming a space therebetween. The bracket or faceplate 118 can be welded to the corner slide-rail post 115.

Figure 4:
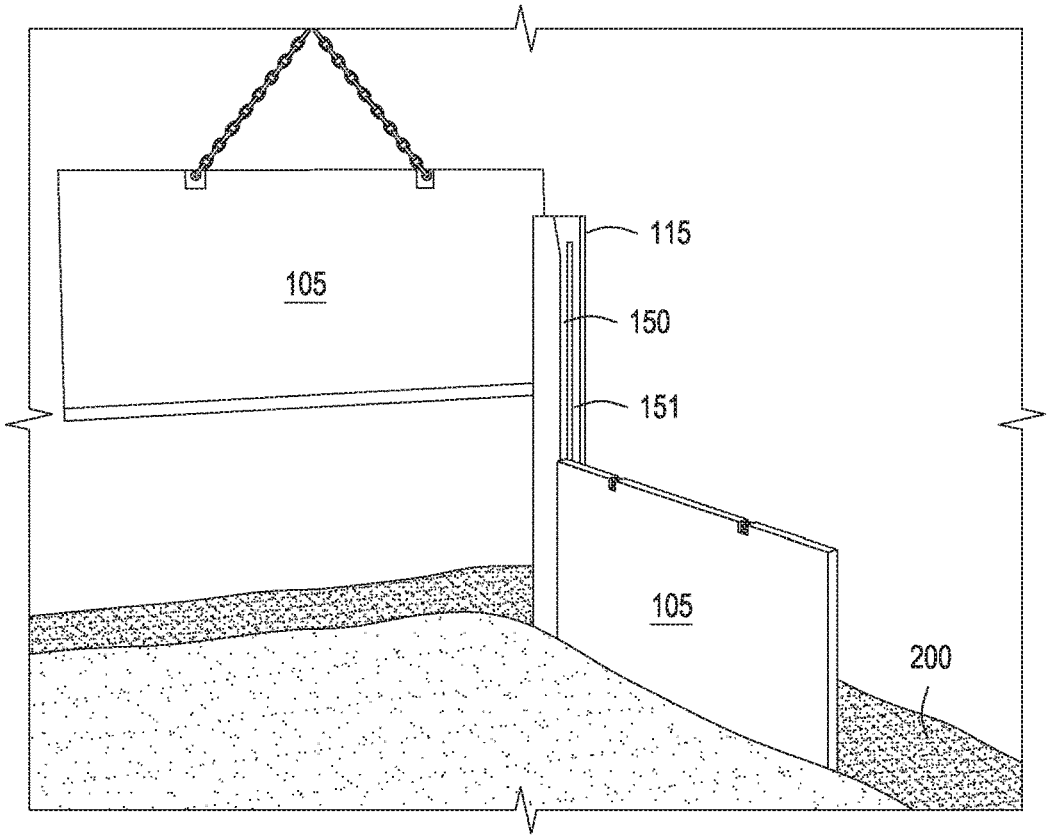
FIG. 4 depicts a front elevation view of an installation of a second slide-rail panel, according to one or more embodiments provided herein.

FIG. 4 depicts a front elevation view of an installation of a second slide-rail panel 105, according to one or more embodiments provided herein. One side of the second slide-rail panel 105 can be inserted into the adjacent recessed groove or track 150 of the corner slide-rail post 115. The second slide-rail panel 105 can be slideably moved in a downward direction, and pushed or driven into the soil using an excavation boom. The first slide-rail panel 105 and the second panel 105 can be adjustably positioned to form an angle therebetween. The angle formed can be an approximate 90-degree angle.

Figure 5:
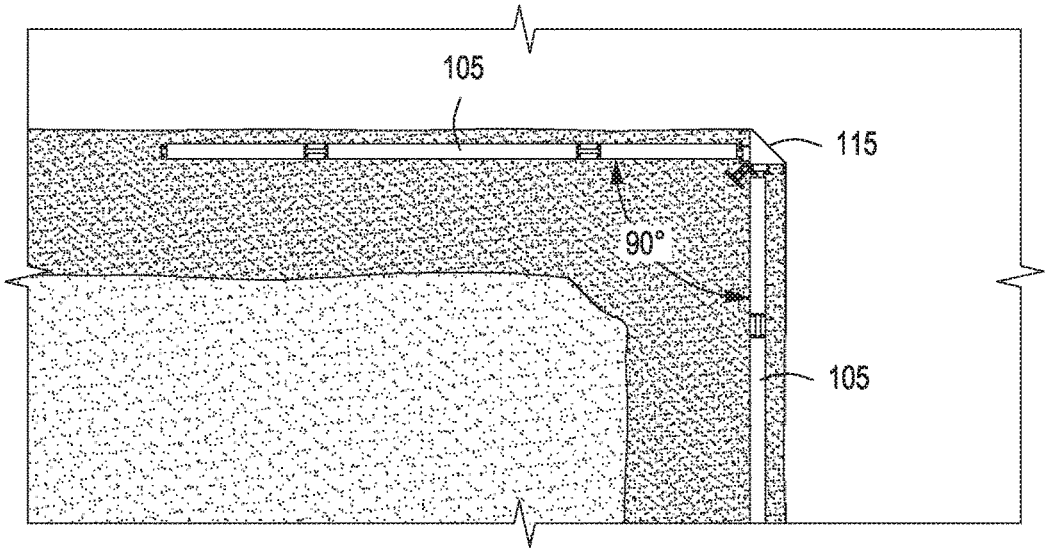
FIG. 5 depicts a plan view of the first corner of the illustrative excavation support system of FIG. 1, showing a corner slide-rail post and a 90-degree angle between adjacent slide-rail panels, according to one or more embodiments provided herein.

FIG. 5 depicts a plan view of the first corner of the illustrative excavation support system 100 of FIG. 1, showing a corner slide-rail post 115 and a 90-degree angle between adjacent slide-rail panels 105, according to one or more embodiments provided herein. The corner slide-rail post 115 can be generally triangular in shape, and can thereby facilitate the approximate 90-degree orientation of the adjacent slide-rail panels 105 that form the corners of the excavation support system 100. It should be noted that the 90-degree corner angle can allow the installation of a four-sided, square, or rectangular excavation support system 100.

Figure 6:
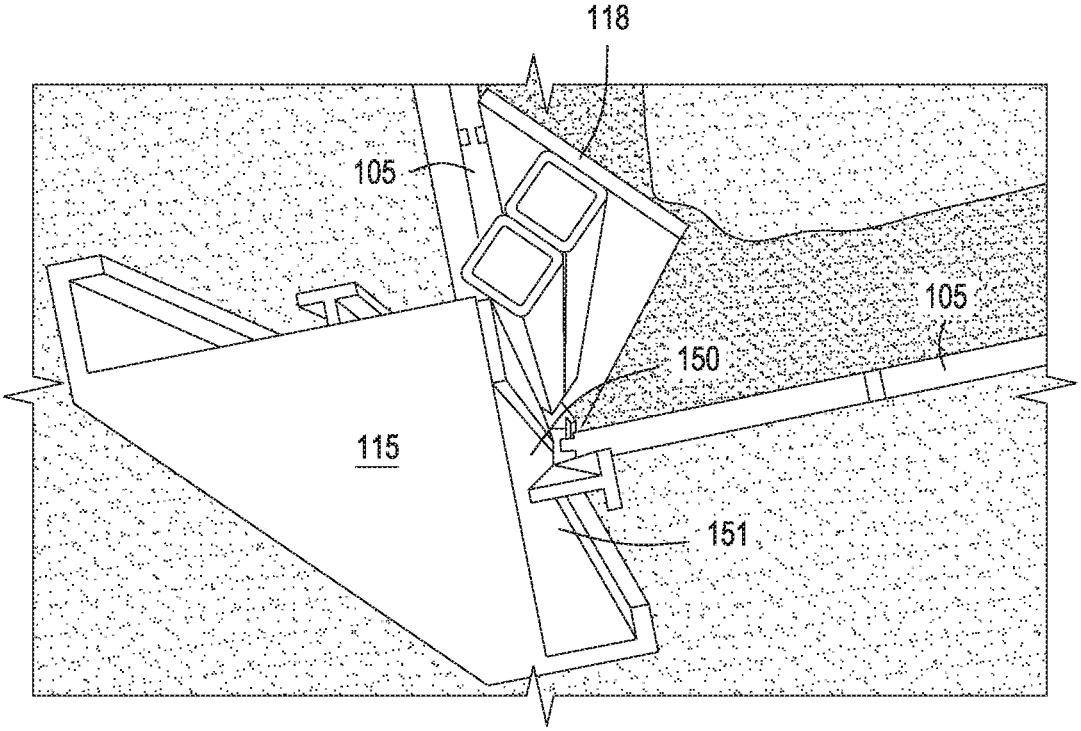
FIG. 6 depicts a top view of the first corner of the illustrative excavation support system of FIG. 1, according to one or more embodiments provided herein.

FIG. 6 depicts a top view of the first corner of the illustrative excavation support system 100 of FIG. 1, according to one or more embodiments provided herein. The triangular configuration of the corner slide-rail 115 is shown in FIG. 6, along with a bracket or faceplate 118, where the bracket 118 can be disposed along the longitudinal axis of the corner slide-rail post 115.

Figure 7:
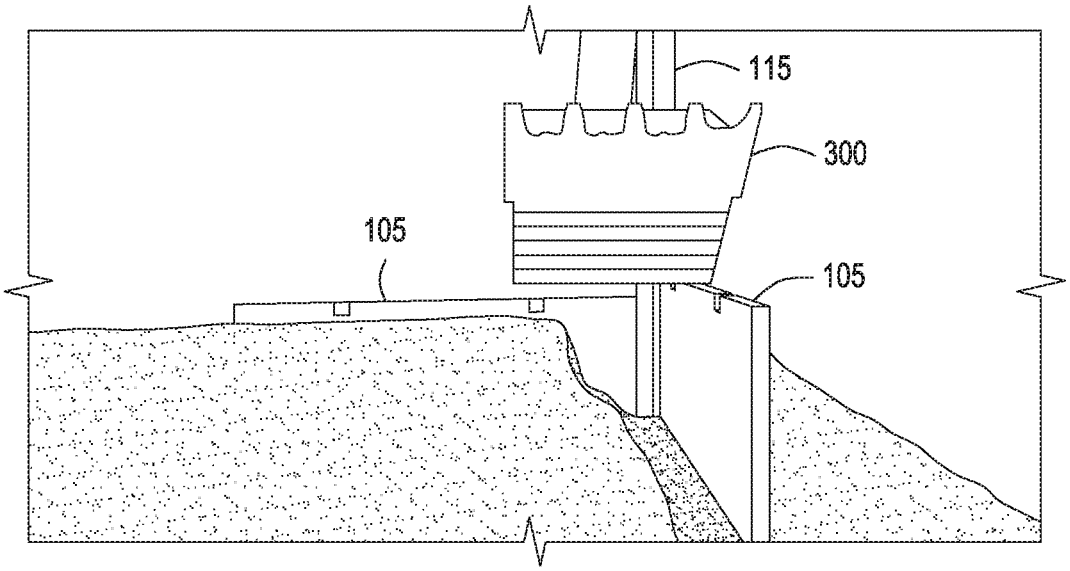
FIG. 7 depicts a front elevation view of the leveling of the first and second slide-rail panels, using the boom of an excavator, according to one or more embodiments provided herein.

FIG. 7 depicts a front elevation view of the leveling of the first and second slide-rail panels, using the boom of an excavator, according to one or more embodiments. The lower level or first ring slide-rail panels 105 can be leveled, or pushed to grade, and made flush with the depth of the pre-excavation trench 200. For example, the leveling, or pushing to grade, can be accomplished by using the boom 300 of an excavator. It should be noted that this leveling process can be performed on each additional lower slide-rail panel 105, as well as the upper or extension slide-rail panels 106. The leveling, or pushing to grade, can facilitate continuous soil support during the excavation process.

Figure 8:
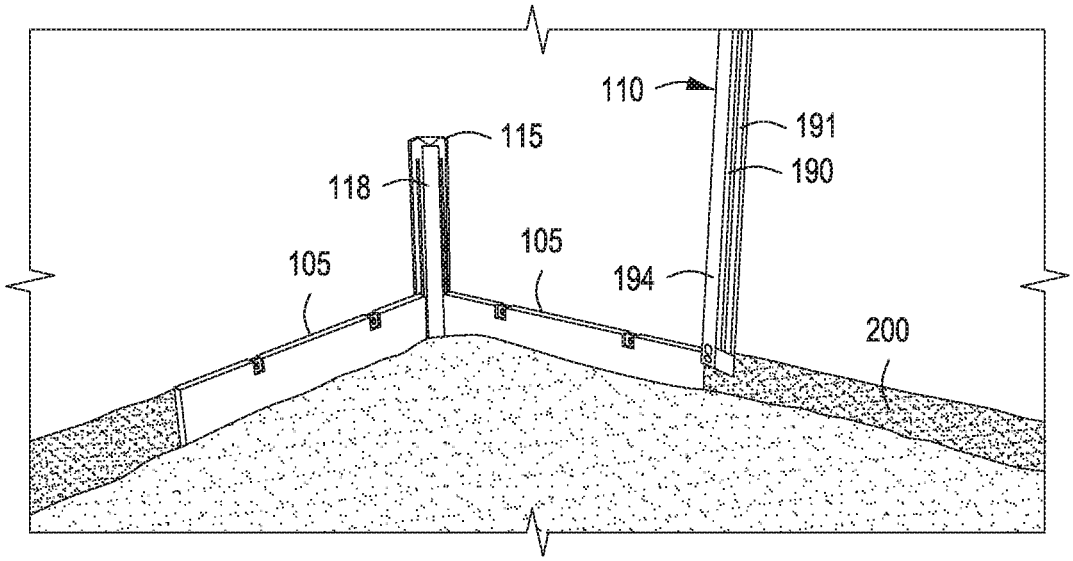
FIG. 8 depicts a front elevation view of an illustrative linear slide-rail post of the illustrative excavation support system of FIG. 1, according to one or more embodiments provided herein.

FIG. 8 depicts a front elevation view of an illustrative linear slide-rail post 110 of the illustrative excavation support system of FIG. 1, according to one or more embodiments provided herein. The linear slide-rail post 110 can be generally vertical and can include two longitudinal grooves or tracks 190, 191. Each longitudinal groove or track 190, 191 can be substantially parallel to one another. For example, one recessed groove or track 190 can be positioned in front of another recessed groove or track 191. More specifically, the front recessed groove or track 190 can function as an outer track, whereas the other recessed groove or track 191 can function as an inner track. Moreover, the linear slide-rail posts 110 can also include an extended faceplate 194 disposed along the longitudinal axis thereof. It should be noted that in some embodiments, the linear slide-rail posts 110 can include three or more longitudinal grooves or tracks to facilitate the installation of three or more slide-rail panels 105, 106. It should also be noted that the linear slide rail can have longitudinal grooves 190, 191 on opposite sides of the linear slide rail post to facilitate the connection of adjacent slide rail panels.

Figure 9:
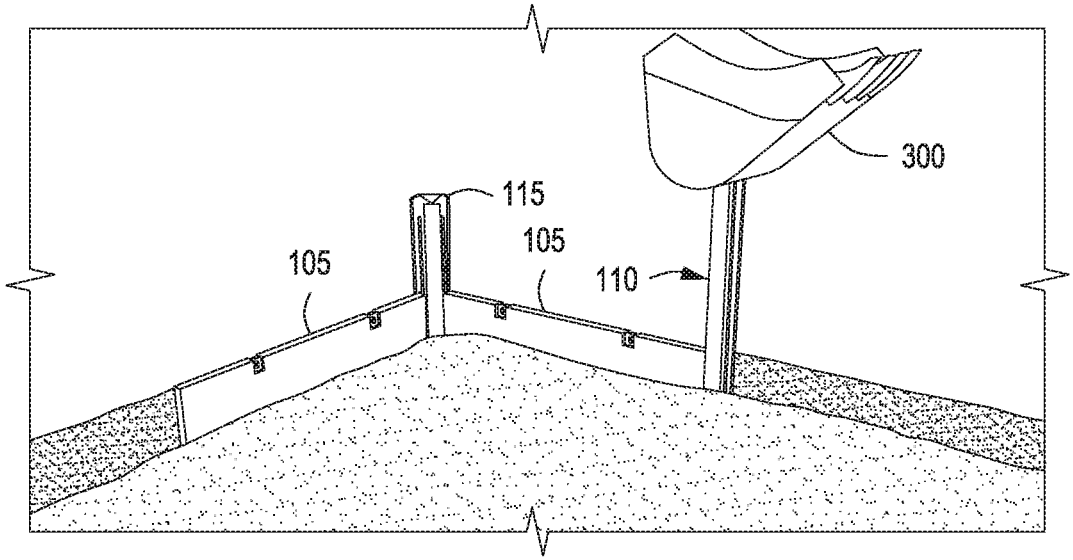
FIG. 9 depicts a front elevation view of the leveling, or pushing to grade, of the illustrative slide-rail post shown in FIG. 8 with the boom of an excavator, according to one or more embodiments provided herein.

FIG. 9 depicts a front elevation view of the leveling, or pushing to grade, of the illustrative slide-rail post shown in FIG. 8 with the boom of an excavator, according to one or more embodiments provided herein. The linear slide-rail post 110 can be installed in the pre-excavation trench 200 by aligning the linear slide-rail post 110 with the free end of either the first or second lower slide-rail panel 105, inserting the free end of the lower slide-rail panel 105 into the outer track 190 (see also FIG. 16, 190) of the linear slide-rail post 110 and sliding the linear slide-rail post 110 in a downward direction to the base of the pre-excavation trench 200. More specifically, once the lower, or first ring, slide-rail panels 105 have been installed, along with the corresponding corner slide-rail posts 115 and linear slide-rail posts 110, a second lower ring of slide rail panels 105 can be installed. Also a upper, or second ring, slide-rail panels 106 can be installed after the first or second lower ring of slide rail panels 105 have been installed.

The linear slide-rail post 110 can be pushed into the soil using the boom of the excavator 300. The linear slide-rail post 110 can be leveled, or pushed to grade, to an approximate depth equal to the corner slide-rail post 115. However, in some embodiments, the linear slide-rail post 110 can be leveled to a depth that can be either greater than or less than the depth of the corner slide-rail post 115. A third lower slide-rail panel 105 can be added by aligning one side of the lower slide-rail panel 105 with the outer track 190 on the free end of the linear slide-rail post 110.

Figure 10:
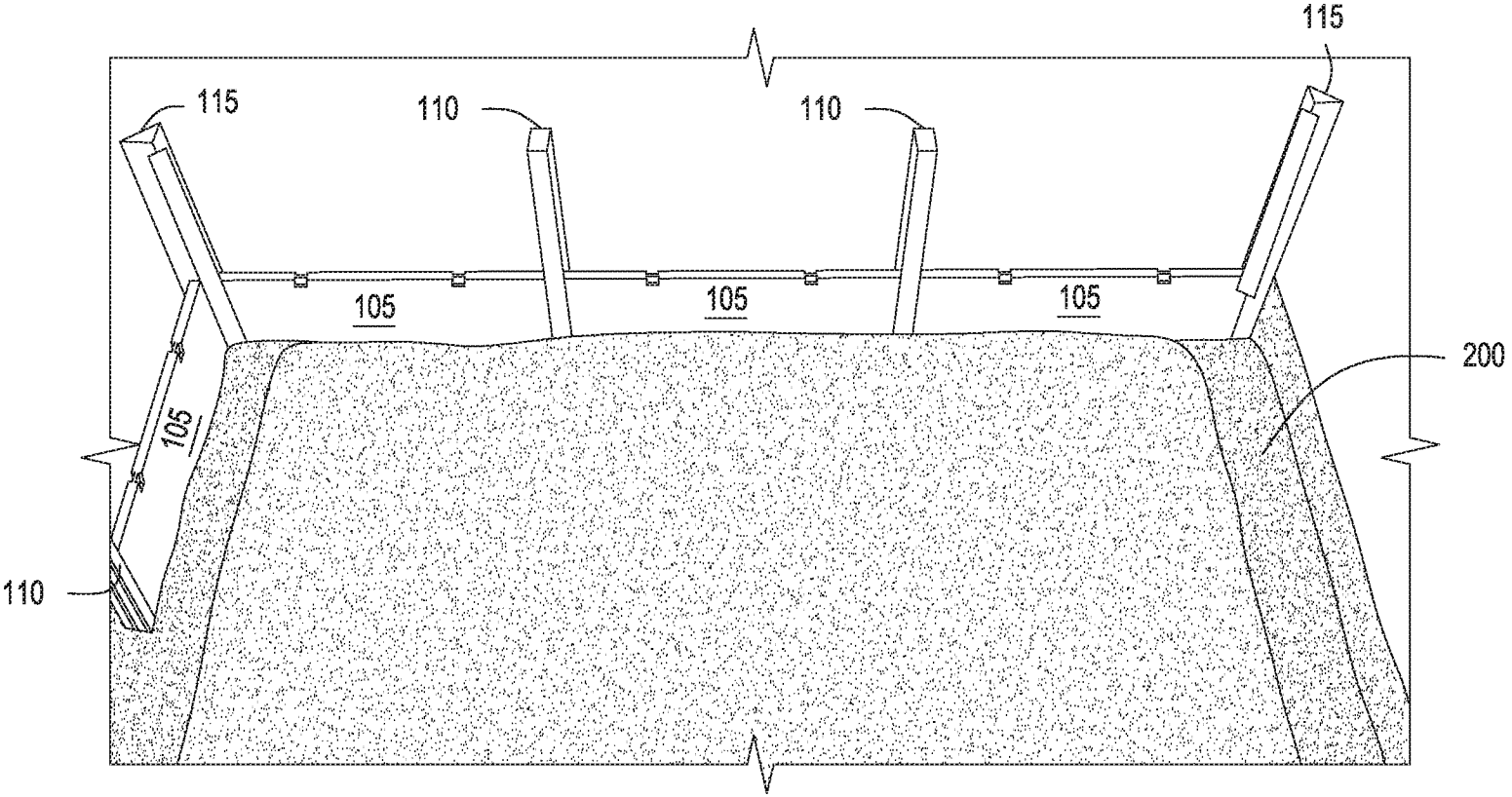
FIG. 10 depicts a top elevation view of the installation of the lower or first ring of slide-rail panels for one side and one corner of the illustrative excavation support system of FIG. 1, according to one or more embodiments.

FIG. 10 depicts a top elevation view of the installation of the lower or first ring of slide-rail panels 105 for one side and one corner of the illustrative excavation support system 100 of FIG. 1, according to one or more embodiments. A second corner slide-rail post 115 can be aligned with the free end of the lower slide-rail panel 105. Similar to the completion of the first corner of the excavation support system 100, as discussed above, an additional lower slide-rail panel 105 can be aligned with and adjoined to the free side of the second corner slide-rail post 115. Successive lower, or first ring, panels 105 and linear slide-rail posts 110 can be added until a third corner of the pre-excavation trench 200 is reached.

Figure 11:
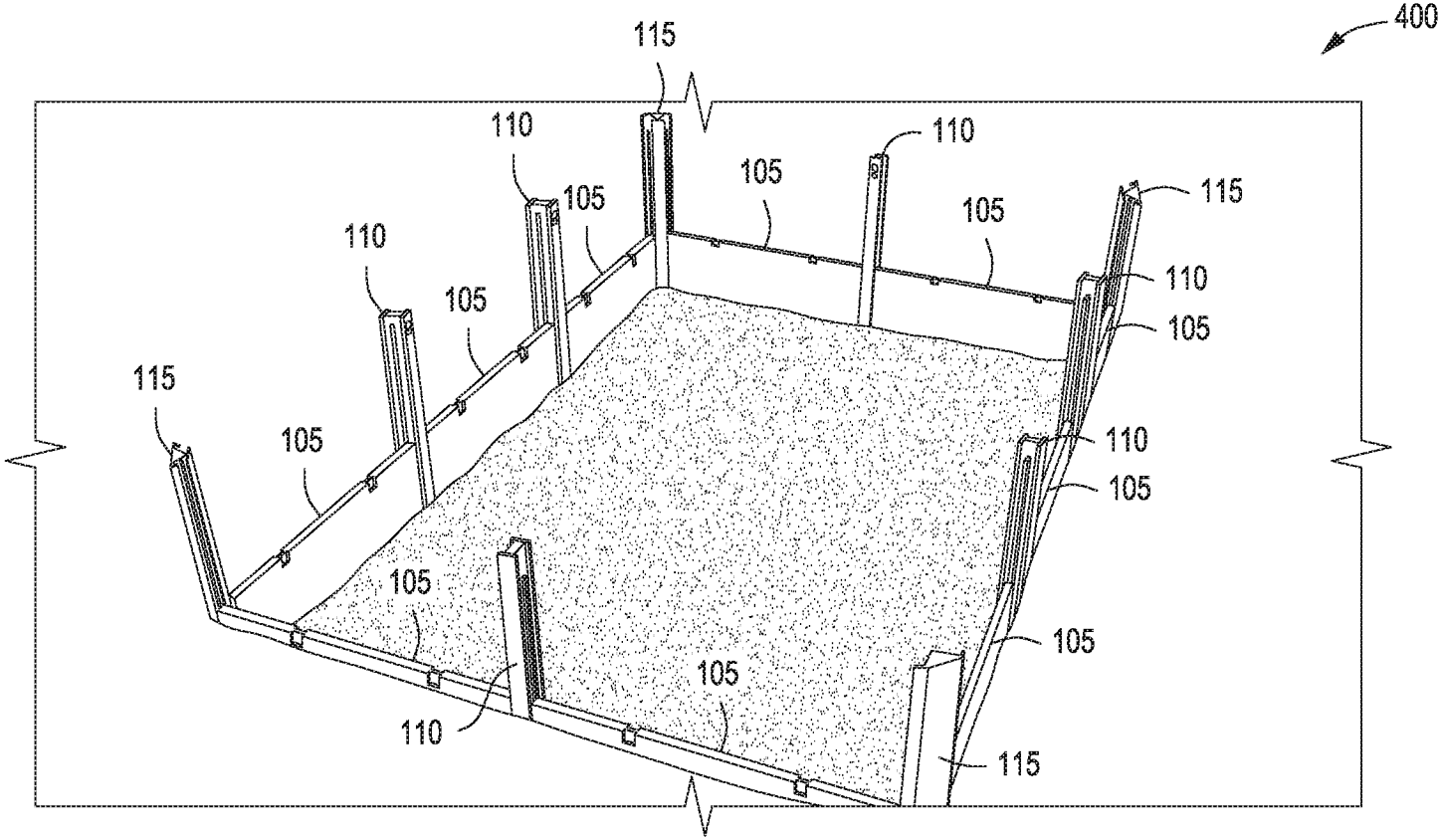
FIG. 11 depicts a top elevation view of the completed installation of the linear slide-rail posts, the corner slide-rail posts, and the lower slide-rail panels of the illustrative excavation support system of FIG. 1, according to one or more embodiments provided herein.

FIG. 11 depicts a top elevation view of the completed installation of the linear slide-rail posts 110, the corner slide-rail posts 115, and the lower slide-rail panels 105 of the illustrative excavation support system 100 of FIG. 1, according to one or more embodiments provided herein. In essence, FIG. 11 shows a completed illustrative base structure 400, which can include a plurality of linear slide-rail posts 110, a plurality of corner slide-rail posts 115, and a plurality of lower slide-rail panels 105. After installation of this first level of panels 105, excavation can take place, thereafter at least a second level of slide-rail panels 106 can be installed, providing necessary soil support.

Figure 12:
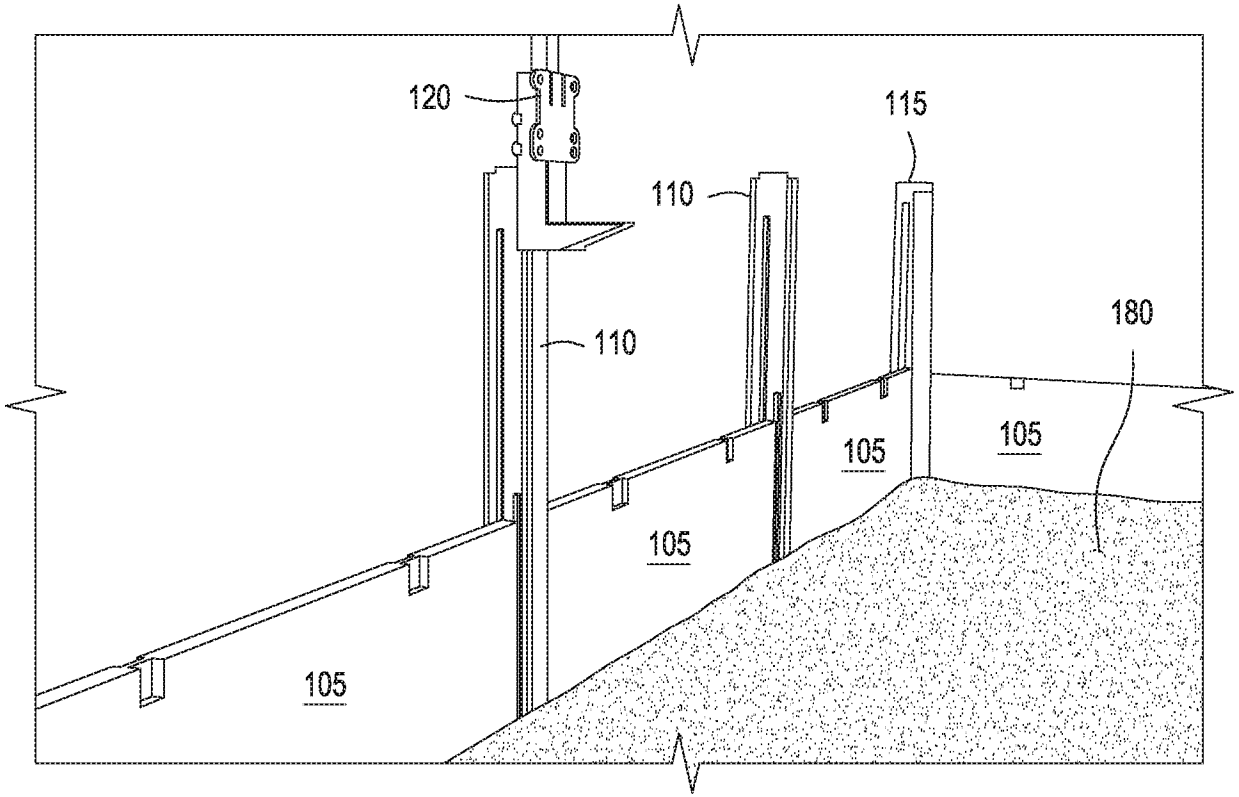
FIG. 12 depicts a front elevation view of the installation of a linear roller cart for the illustrative excavation support system of FIG. 1, according to one or more embodiments provided herein.
Figure 12A:
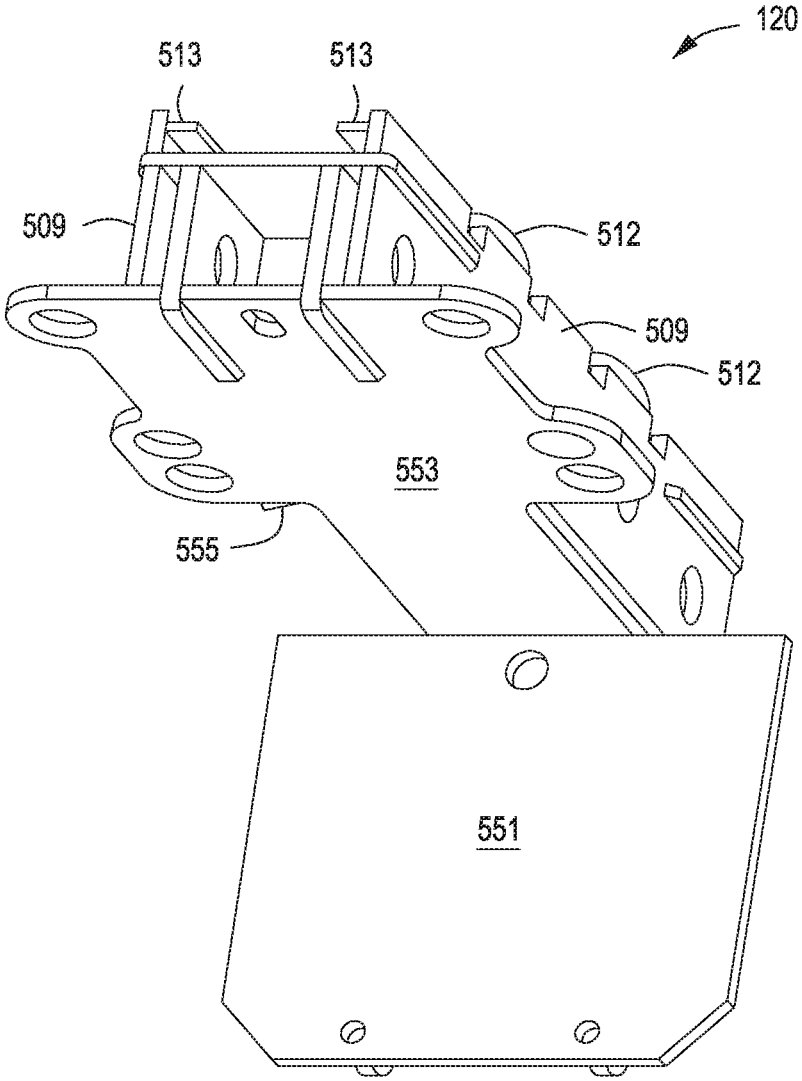
FIG. 12A depicts a side elevation view of an illustrative linear roller cart, according to one or more embodiments provided herein.

FIG. 12 depicts a front elevation view of the installation of a linear roller cart 120 for the illustrative excavation support system 100 of FIG. 1, according to one or more embodiments provided herein. FIG. 12A depicts a side elevation view of an illustrative linear roller cart, according to one or more embodiments provided herein. The linear roller cart 120 can include a front surface 553, a back surface 555, a substantially horizontal base plate 551, a first side plate 509, a second side plate 509, and a plurality of guide plates 513. The first and second side plates 509 can be parallel to one another. The plurality of guide plates 513 can be fixedly attached to, and generally perpendicular to each side plate 509.

Figure 12B:
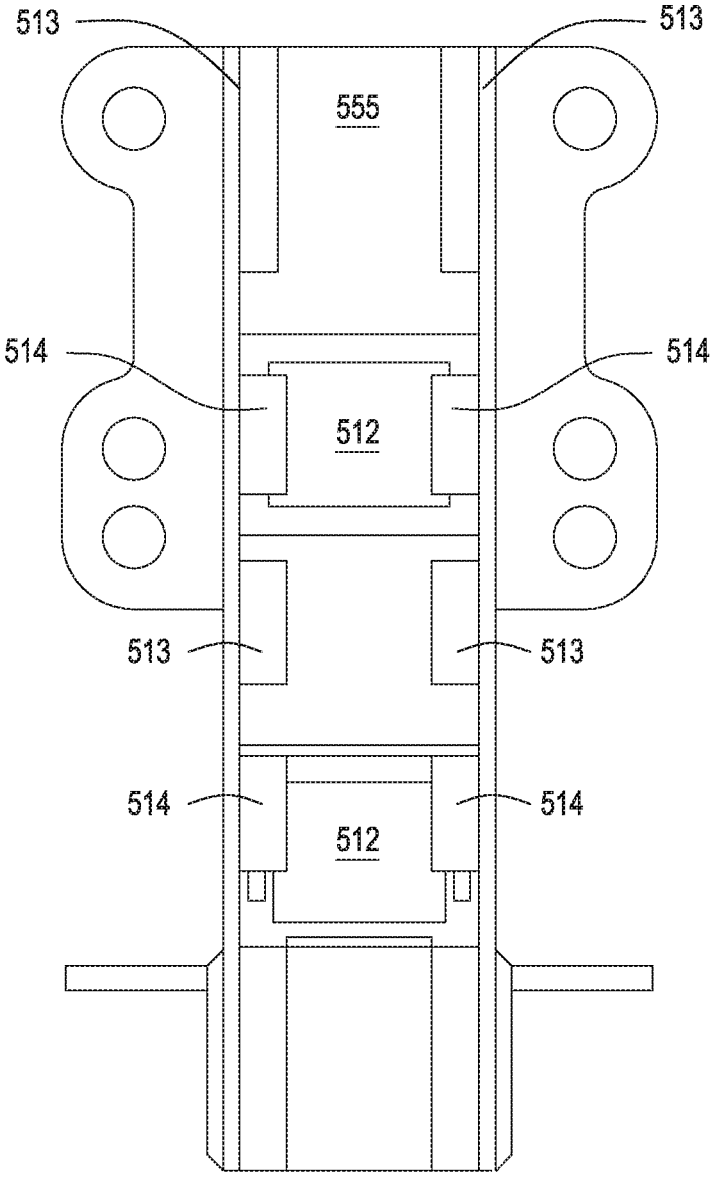
FIG. 12B depicts a plan view of the back side of an illustrative linear or corner roller cart for an illustrative excavation support system, according to one or more embodiments provided herein.

FIG. 12B depicts a plan view of the back side 555 of an illustrative linear or corner roller cart 120, 125 for an illustrative excavation support system 100, according to one or more embodiments provided herein. The back surface 555 of the linear or corner roller cart 120, 125 can include at least one roller 512, where the at least one roller 512 can be positioned between the side plates 509, and secured in place by a housing or rigid caster 514. FIG. 12B also depicts apertures 534, 538, and 540 that can be used as lift points for the purpose of moving the linear or corner roller cart 120, 125 in the upward and downward direction, or as connecting points for the purpose of connecting the linear or corner roller cart 120, 125 to the linear or corner slide-rail post 110, 115, or for connecting one or more hydraulic brace legs (see FIG. 19, 130) to the linear or corner roller cart 120, 125.

Figure 12C:
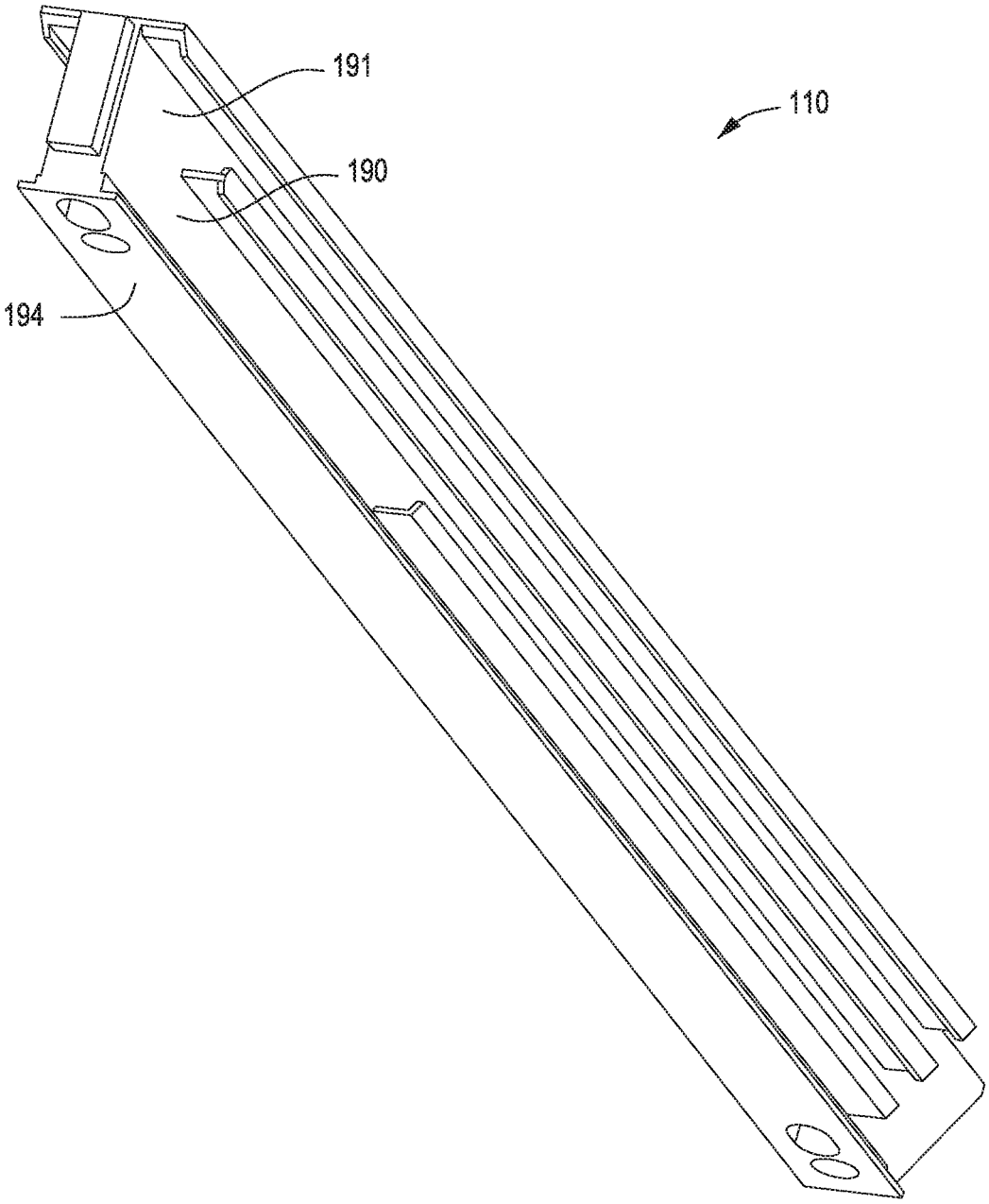
FIG. 12C depicts a side elevation view of an illustrative linear slide-rail post, according to one or more embodiments provided herein.

FIG. 12C depicts a side elevation view of an illustrative linear slide-rail post 110, according to one or more embodiments provided herein. The at least one roller 512 can have frictional contact with the extended faceplate 194, facilitating ease of movement of the linear roller cart 120 in the upward and downward direction. The extended faceplate 194 can be disposed along the longitudinal axis of the linear slide-rail post 110. The plurality of guide plates 513 on the linear roller cart 120 can be configured to thread or clamp along the vertical edge of the extended faceplate 194 of the linear slide-rail post 110. As discussed above, the front recessed groove or track 190 can function as an outer track 190, wherein the first or lower slide-rail panel 105 can be slideably positioned therein. The other recessed groove or track can function as an inner track 191, wherein the second slide-rail panel or extension panel 106 can be slideably positioned therein. It should be noted that, in some embodiments, the linear slide-rail post 110 can include at least three recessed grooves or tracks 190, 191.

Referring again to FIG. 12, after the completion of the base structure 400, a first linear roller cart 120 can be slideably connected to a linear slide-rail post 110. The first linear roller cart 120 can be moved in a downward direction to the desired stopping position, where the stopping position can be at the base of the trench 180. A second and any subsequent linear roller carts 120 can be slideably connected to each additional linear slide-rail post 110. Each subsequent linear roller cart 120 can be moved in the downward direction to the desired position, where the desired position can be proximate the base of the excavation trench 180. For example, the desired position can be in alignment with the first and any other previously installed linear roller carts 120.

Figure 13:
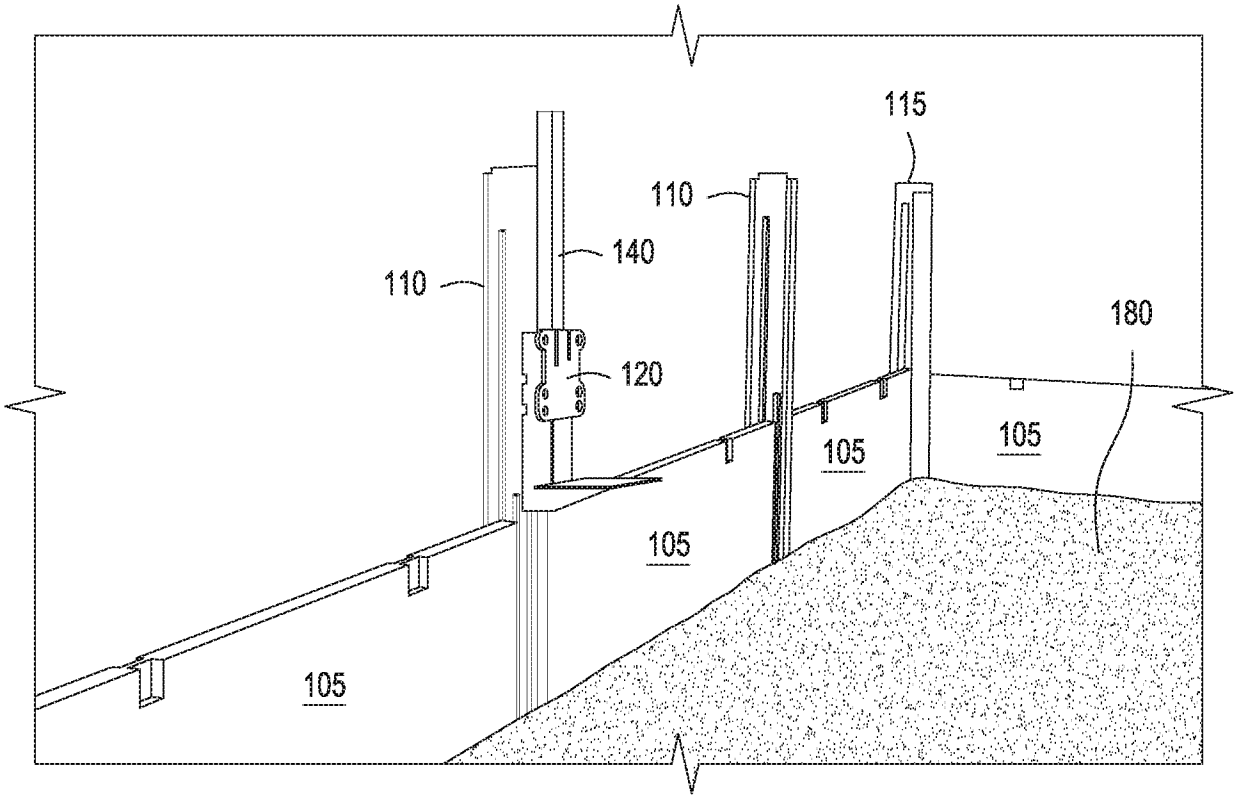
FIG. 13 depicts a front elevation view of the installation of the linear roller cart of FIG. 12A with a linking tube attached thereto, according to one or more embodiments provided herein.

FIG. 13 depicts a front elevation view of the installation of the linear roller cart of FIG. 12A with a linking tube attached thereto, according to one or more embodiments provided herein. The linking tube 140 can facilitate the vertical connection of two or more linear roller carts 120. For example, in some embodiments, depending upon the desired depth of the excavation, at least one additional linear roller cart 120 can be connected to each of the first, second, and any subsequent linear roller carts 120. The linking tube 140 can have a top end and a bottom end. For example, the top end of the linking tube 140 connected to the first or lower linear roller cart 120 can be connected to a second or upper linear roller cart 120, thereby facilitating the vertical connection of at least two linear roller carts 120. Similarly, linking tubes 140 can also facilitate the vertical connection of at least two corner carts 125.

Figure 14:
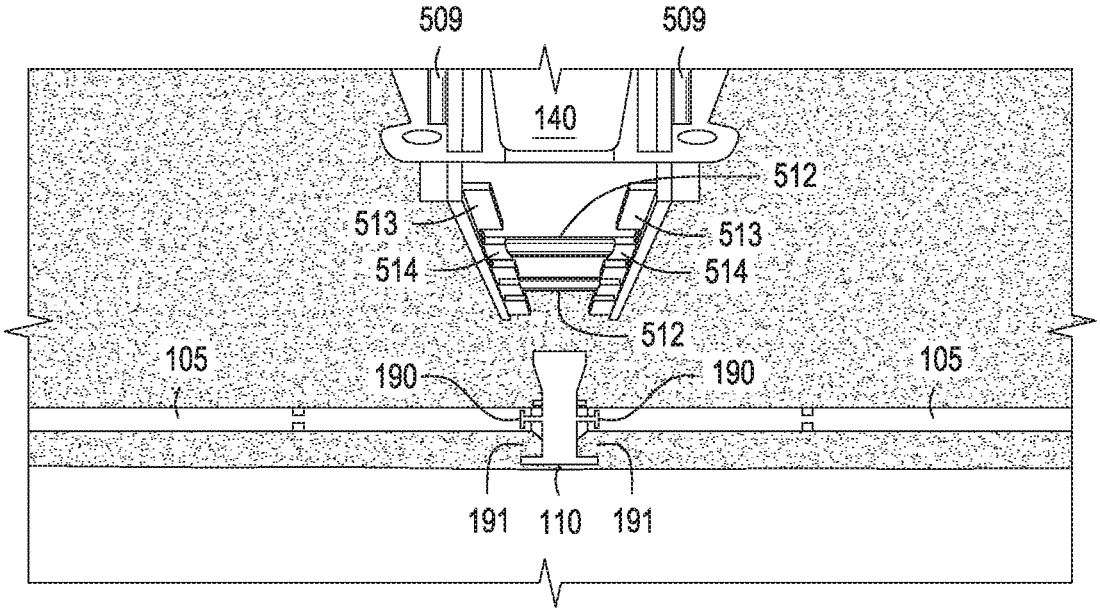
FIG. 14 is an elevation view depicting the back side of the illustrative linear roller cart of FIG. 12A, as the linear roller cart is being installed onto the linear slide-rail post according to one or more embodiments provided herein.
Figure 15:
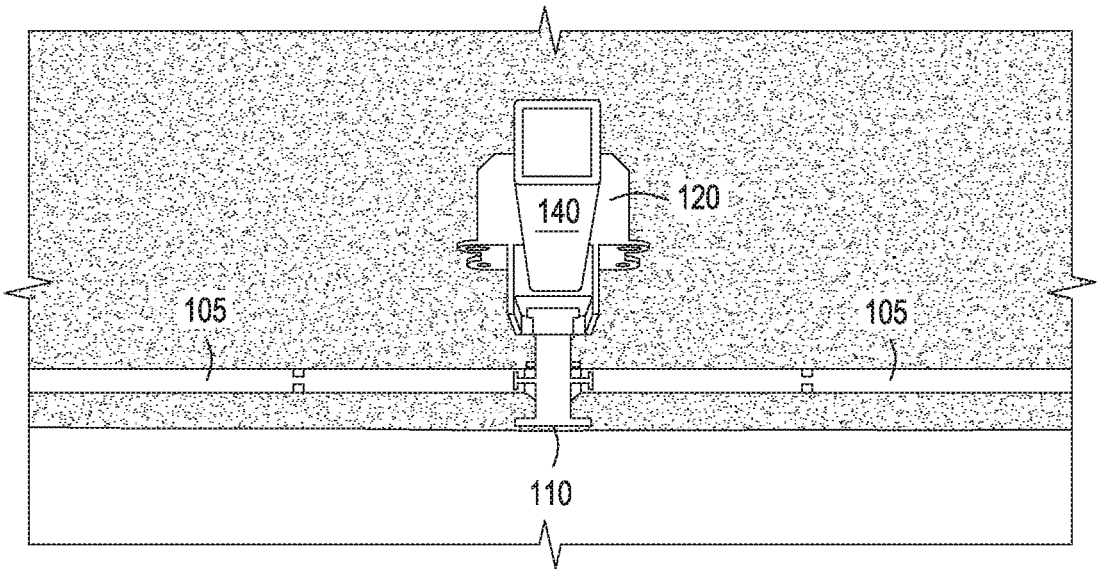
FIG. 15 depicts a top elevation view of the installation of the linear roller cart of FIG. 12A, with a linking tube, for the illustrative excavation support system of FIG. 1, according to one or more embodiments provided herein.

FIG. 14 is an elevation view depicting the back side of the illustrative linear roller cart 120 of FIG. 12A, as the linear roller cart 120 is being installed onto the linear slide-rail post 110 according to one or more embodiments provided herein. As shown, in some embodiments, the guide plates 513 can essentially be configured to clamp or thread around an extended edge of the faceplate 194 of the linear slide-rail post 110 (see also FIG. 17). FIG. 15 depicts a top elevation view of the installation of the linear roller cart of FIG. 12A, with a linking tube, for the illustrative excavation support system of FIG. 1, according to one or more embodiments provided herein.

Figure 16:
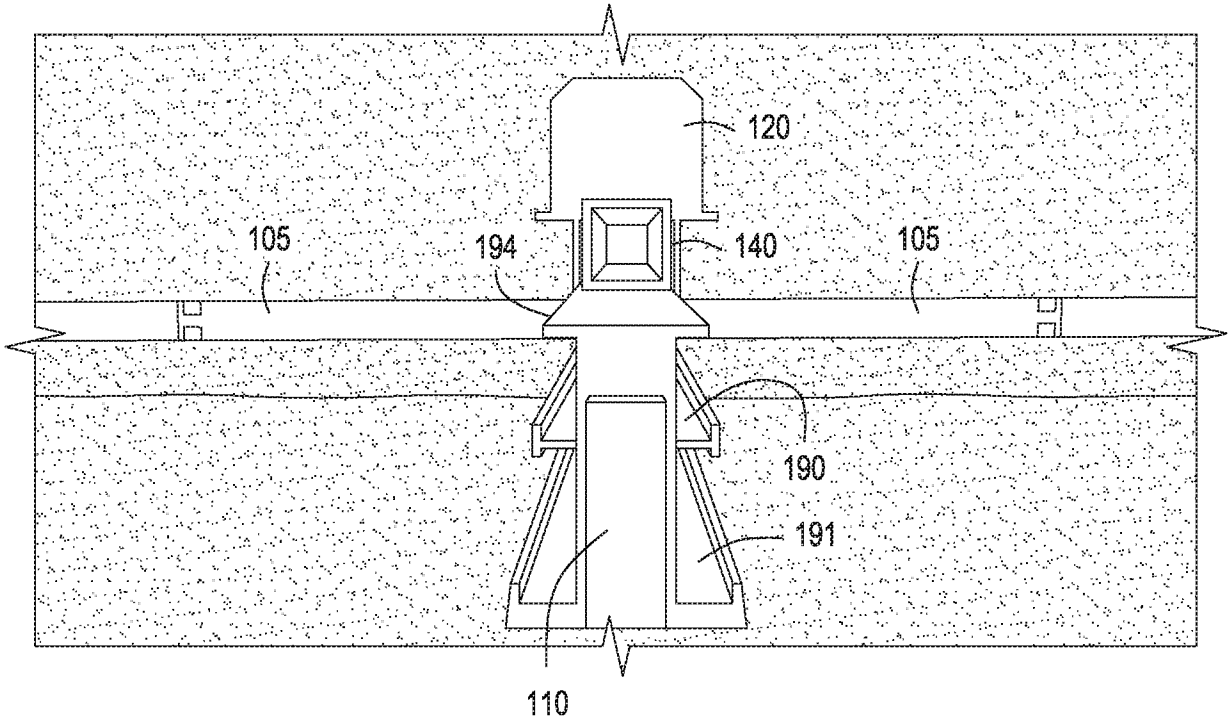
FIG. 16 depicts a top elevation view of the installation of the linear roller cart of FIG. 12A showing the recesses or tracks and the extended faceplate of the linear slide-rail post for the illustrative excavation support system of FIG. 1, according to one or more embodiments provided herein.

FIG. 16 depicts a top elevation view of the installation of the linear roller cart of FIG. 12A showing the recesses or tracks and the extended faceplate of the linear slide-rail post for the illustrative excavation support system of FIG. 1, according to one or more embodiments provided herein. As shown, the extended edge of the faceplate 194 can facilitate slideable movement of the linear roller cart 120 in an upward and downward direction relative to the vertical axis of the linear slide-rail 110.

Figure 17:
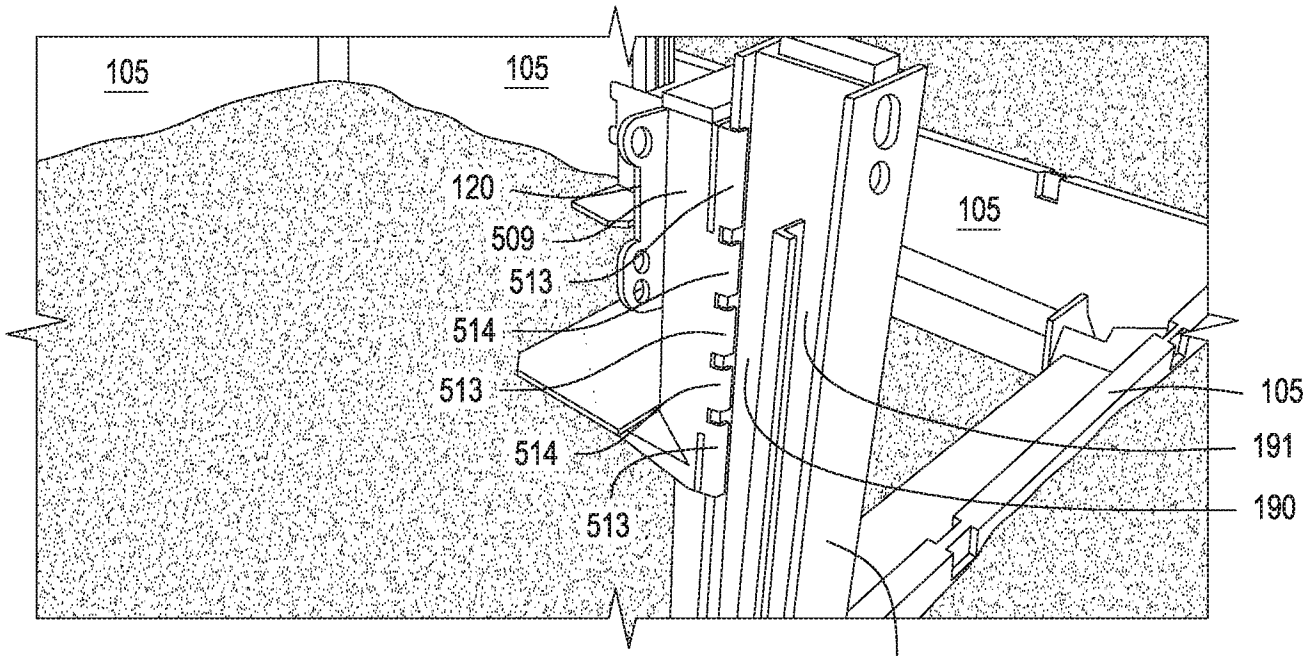
FIG. 17 depicts a side elevation view of the linear roller cart of FIG. 12A, showing a side plate, guide plates, and the insertion of the guide plates into a recess or track of linear slide-rail post for the illustrative excavation support system of FIG. 1, according to one or more embodiments provided herein.

FIG. 17 depicts a side elevation view of the linear roller cart of FIG. 12A, showing a side plate, guide plates, and the insertion of the guide plates into a recess or track of linear slide-rail post for the illustrative excavation support system of FIG. 1, according to one or more embodiments provided herein. As discussed above, FIG. 17 further depicts the connection of the linear roller cart 120 to the extended faceplate 194 of the linear slide-rail post 110. The linear roller cart 120 can be configured to slide onto the linear slide-rail post 110 along the extended faceplate 194. The plurality of guide plates 513 can be configured to essentially thread onto or clamp around the edge of the extended faceplate 194, thereby facilitating movement of the linear roller cart 120 in an upward and downward direction relative to the vertical axis of the linear slide-rail post 110.

Figures 1, 18:
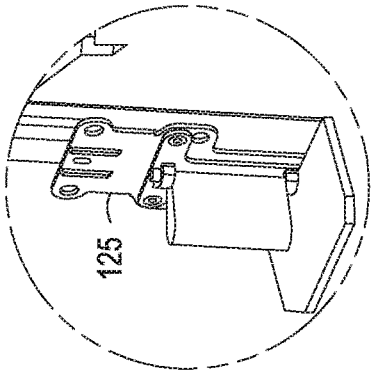
FIG. 18 depicts an elevation view of the completed installation of the linear slide-rail posts, corner slide-rail posts, the lower or first ring slide-rail panels, the lower linear carts, and the lower corner slide carts of the illustrative excavation support system of FIG. 1, according to one or more embodiments provided herein.
Figure 18:
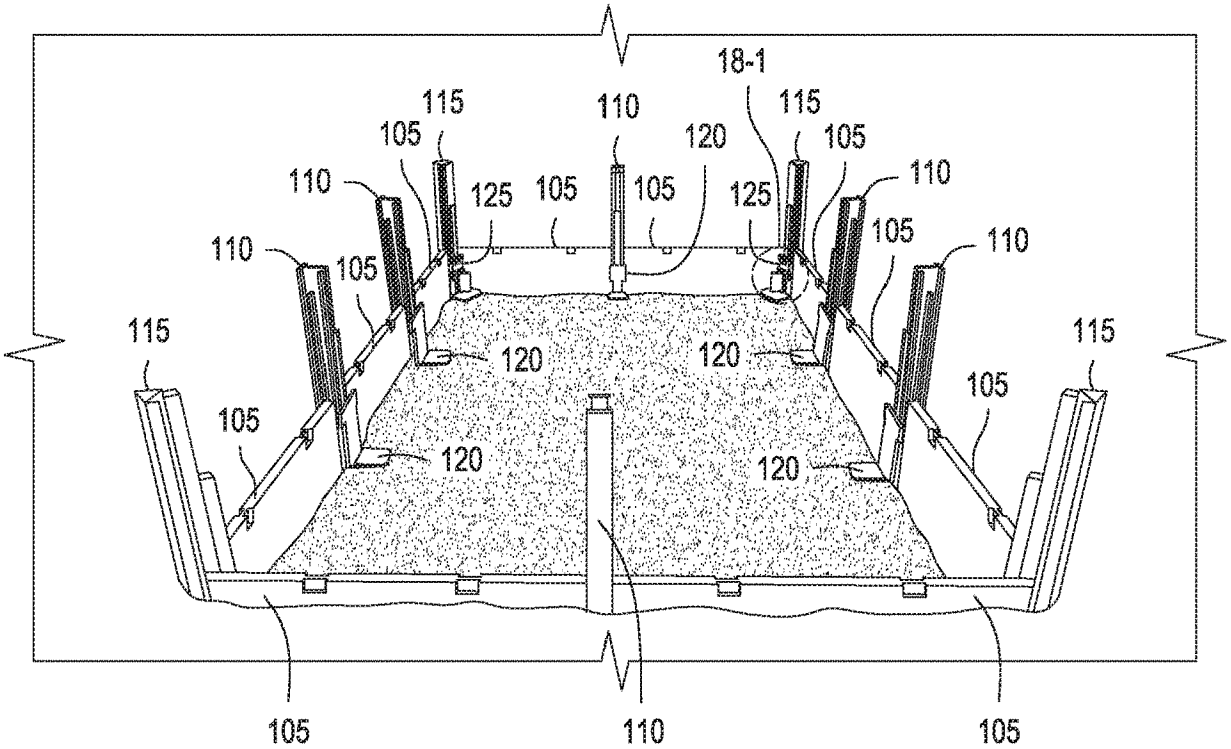
Figure 18A:
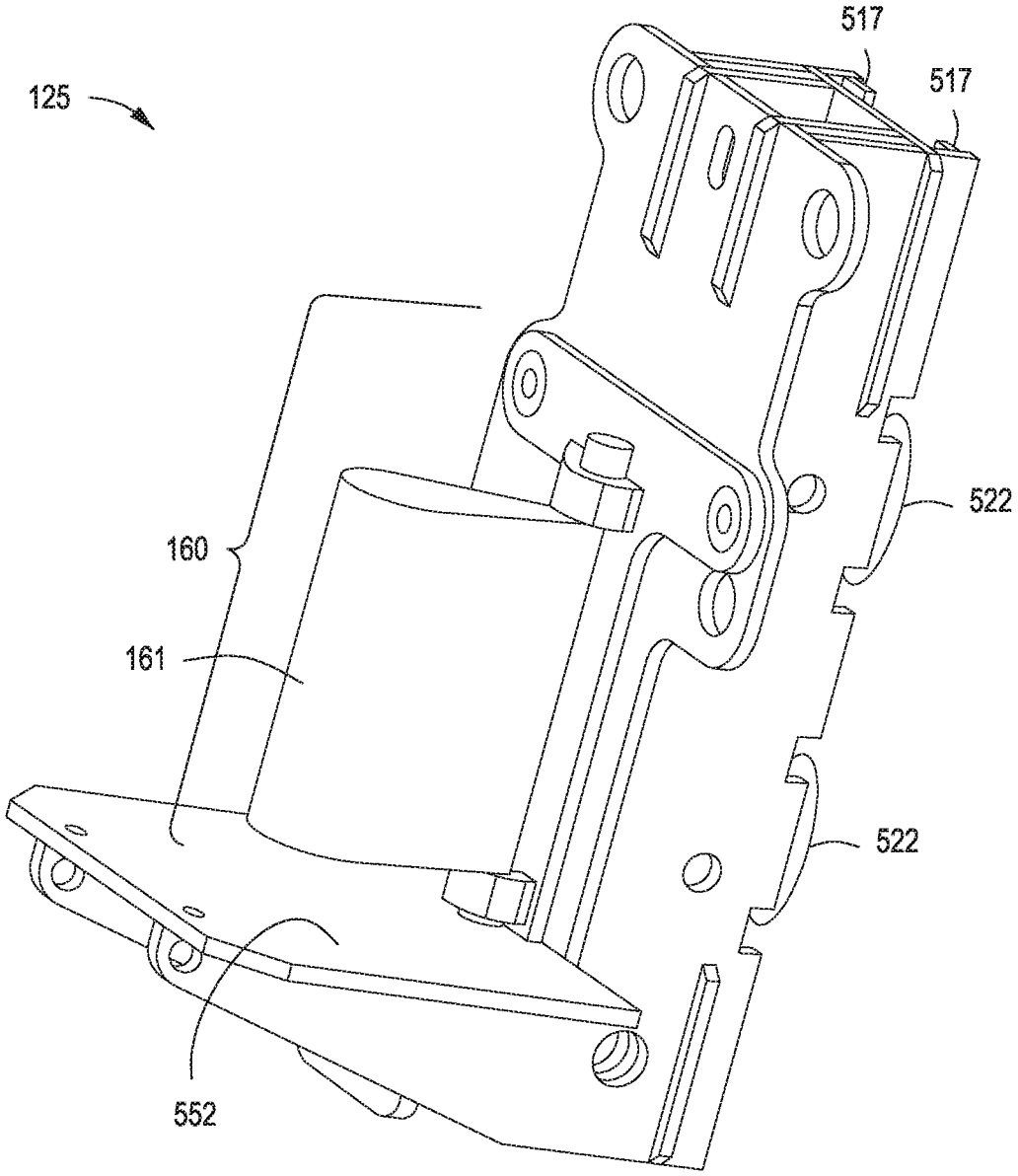
FIG. 18A depicts a side elevation view of a corner roller cart, according to one or more embodiments provided herein.

FIG. 18 depicts an elevation view of the completed installation of the linear slide-rail posts, corner slide-rail posts, the lower or first ring slide-rail panels, the lower linear carts, and the lower corner slide carts of the illustrative excavation support system of FIG. 1, according to one or more embodiments provided herein. The linear roller cart 120 and the corner roller cart 125 can be positioned at similar depths and positions. FIG. 18A-1 is a cut-out view from FIG. 18A, depicting the details of the corner roller cart 125, according to one or more embodiments provided herein.

FIG. 18A depicts a side elevation view of a corner roller cart 125, according to one or more embodiments provided herein. As shown, similar to the linear roller cart 120, the corner roller cart 125 can include at least one roller 522 configured to contact the extended faceplate 118 of the corner slide-rail post 115. Likewise, the corner roller cart 125 can also include a plurality of guide plates 517 that can be configured to thread onto or clamp around the extended faceplate 118 of the corner slide-rail post 115. The corner roller cart 125 can also include a corner swivel brace assembly 160. The corner swivel brace assembly 160 can include a generally vertical teardrop support 161 configured to position two hydraulic brace legs 130 and to define an approximate 90-degree angle therebetween. It should be noted that other angles ranging from 20° to 160° can be easily accommodated with minor modification.

Figure 18B:
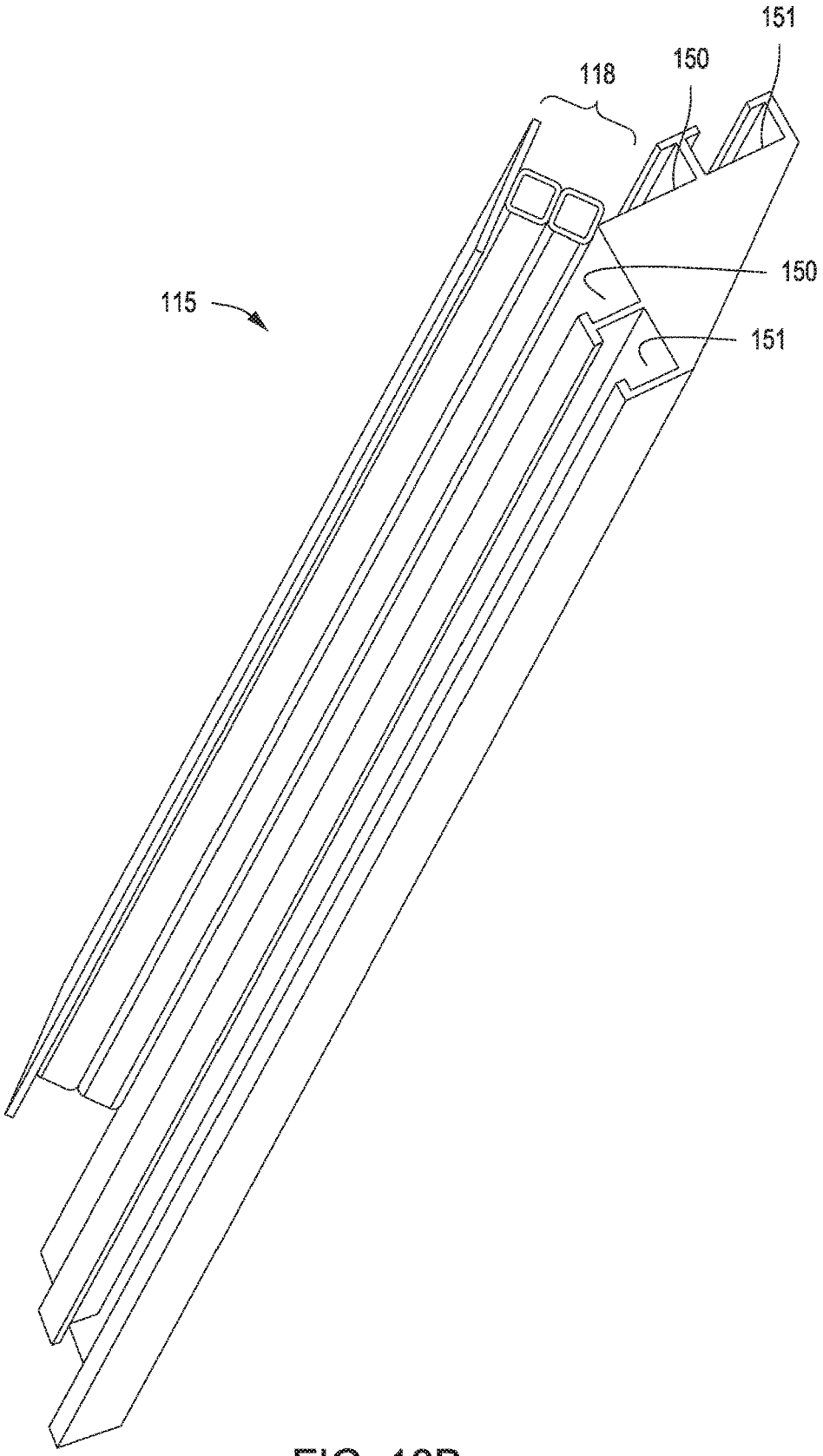
FIG. 18B depicts a side elevation view of a corner slide-rail post, according to one or more embodiments provided herein.

FIG. 18B depicts a side elevation view of a corner slide-rail post 115, according to one or more embodiments provided herein. The at least one roller 512 of the corner roller cart 125 can contact the corner slide-rail post 115 on the faceplate 118. The plurality of guide plates 513 of the corner roller cart 125 can be configured to threadably connect or clamp to the corner slide-rail post 115 at or near the extended faceplate 118. As discussed above, the front recessed groove or track 150 can function as the outer track 150, wherein the first or lower slide-rail panel 105 can be slideably positioned therein. Another recessed groove or track 151 can function as an inner track 151, wherein the second lower slide-rail panel 105 or extension panel can be slideably positioned therein. The triangular shape of the corner slide-rail post 115 can facilitate defining an approximate 90-degree corner angle after the installation of the slide-rail panels 105.

Figure 19:
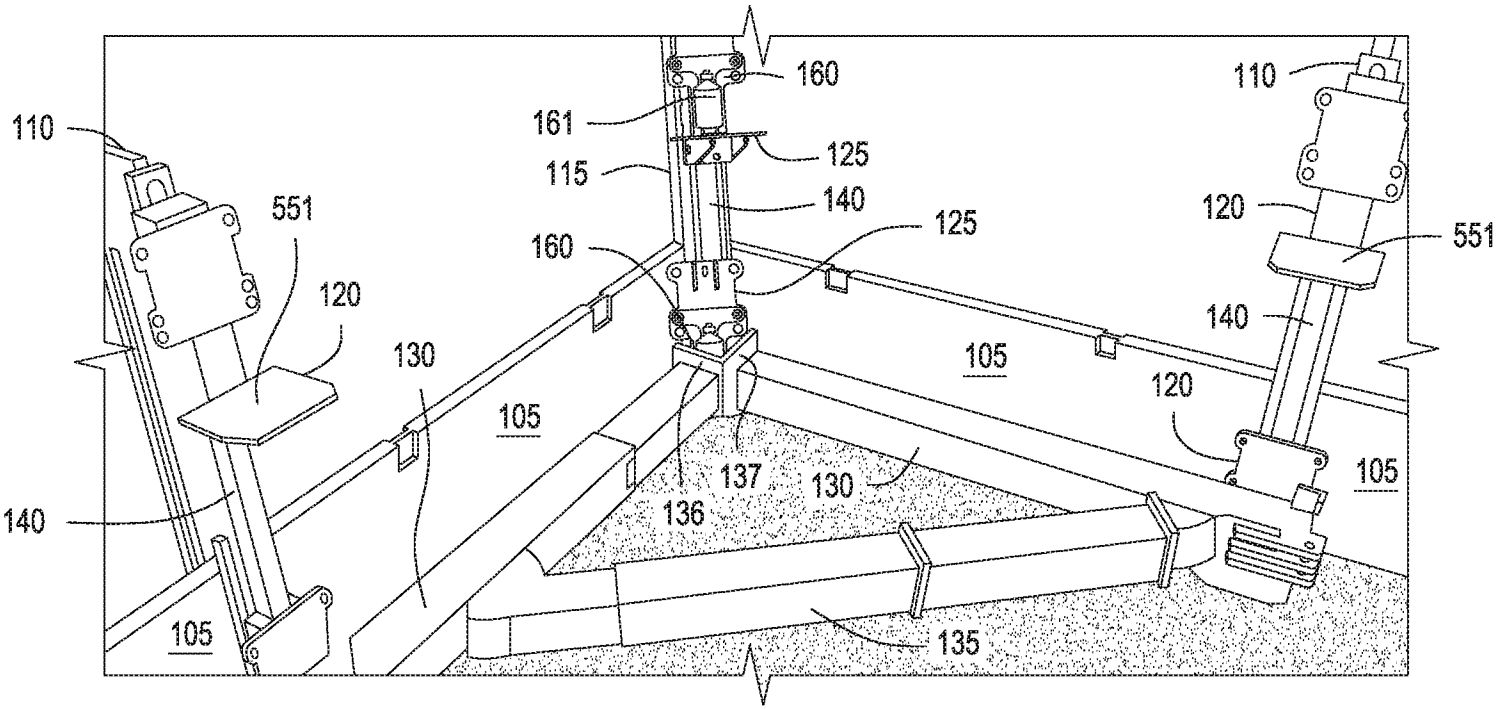
FIG. 19 depicts a front elevation view of the installation of at least a first leg and a second leg of a hydraulic brace and a hydraulic knee brace or crossing brace, for the illustrative excavation support system of FIG. 1, according to one or more embodiments provided herein.

FIG. 19 depicts a front elevation view of the installation of at least a first leg 130 and a second leg 130 of a hydraulic brace and a hydraulic knee brace or crossing brace 135, for the illustrative excavation support system 100 of FIG. 1, according to one or more embodiments provided herein.

In some embodiments, after the completion of the foregoing installation, hydraulic brace legs 130 can be lowered into the excavation trench 180. For example, in a four-sided application, where the excavation trench 180 can be square or rectangular shaped, there can be four hydraulic brace legs 130. Each leg 130 can include a hydraulic power unit (not shown), where the hydraulic power unit can be powered by an enclosed hydraulic cylinder. Each hydraulic brace leg 130 can be positioned between a corner slide-rail post 115 and a linear slide-rail post 110. For example, a first hydraulic brace leg 130 can be positioned between the first corner slide-rail post 115 and the first linear slide-rail post 110. One end 139 of the first hydraulic brace leg 130 can be disposed on the base plate 551 of a first linear roller cart 120, and the opposing end 137 of the first hydraulic brace leg 130 can be disposed on the base plate 552 of the first corner roller cart 125, adjacent to one side of the corner swivel brace assembly 160.

As mentioned above, the corner swivel brace assembly 160 can include a generally vertical teardrop support 161 that can facilitate connecting the ends 136, 137 of two hydraulic brace legs 130, forming an approximate 90-degree angle therebetween. In some embodiments, the hydraulic brace legs 130 can remain positioned by the force of the hydraulic pressure applied thereto. In other embodiments, the ends of the first hydraulic brace leg 130 can be securely connected to the first linear roller cart 120 and the first corner roller cart 125 and corresponding corner swivel brace assembly 160 with connectors, such as a pin, bolt, screw, dowel, or any other appropriate connector.

A first hydraulic knee brace or crossing brace 135 can be placed in diagonal alignment, positioned between the first and the second hydraulic brace legs 130. It should be noted that, in some embodiments, struts (not shown) can be used in lieu of knee braces or crossing braces 135. One end of the first hydraulic knee brace or crossing brace 135 can be securely connected to the first hydraulic brace leg 130, while the opposing end of the hydraulic knee brace or crossing brace 135 can be securely connected to the second hydraulic brace leg 130. In some embodiments, the secured connection between the first hydraulic knee brace or crossing brace 135 with both the first and the second hydraulic brace legs 130 can be achieved with applying hydraulic pressure thereto. In other embodiments, the secured connection between the first hydraulic knee brace or crossing brace 135 can be achieved with connectors, such as a pin, bolt, screw, dowel, or any other appropriate connector.

Referring again to FIG. 1, depending upon the desired depth of the excavation support system 100, at least one additional linear roller cart 120 can be connected to each of the first, second, and any subsequent lower linear roller carts 120, in vertical alignment thereof, by the addition of a linking tube 140 to at least each of the lower linear roller carts 120. Likewise, at least one additional corner roller cart 125 can be connected to each of the lower corner roller carts 125, in vertical alignment thereof, by the addition of a linking tube 140 to at least each of the lower corner roller carts 125. It should be noted that an additional linear roller cart 120 and corner roller cart 125, connected in vertical alignment, and facilitated by the addition of a linking tube 140 can also require the addition of the required number of upper slide-rail panels or extension panels 106. For example, in some embodiments, the upper slide-rail panels or extension panels 106 can be added to the excavation support system 100 by insertion into the grooves 190 or 191 of the linear slide-rail posts 110 and the corresponding tracks 150, 151 of the corner slide-rail posts 115.

Another method for installing an excavation support system as provided herein can include assembling the base structure 400 in the pre-excavation trench 200. The base structure 400 can include: a plurality of linear slide-rail posts 110, wherein each linear slide-rail post 110 can have at least one recessed groove 190, 191 formed in a longitudinal axis thereof; a plurality of corner slide-rail posts 115, wherein each corner slide rail post can have two substantially parallel recessed grooves 150, 151 formed in a longitudinal axis thereof, wherein the two substantially parallel recessed grooves 150, 151 can define an angle therebetween; and at least one slide-rail panel 105 having opposing first and second ends, wherein the first end can be disposed within the recessed groove 190 of the linear slide-rail post 110 and the second end can be disposed within one of the recessed grooves 150 of the corner slide-rail posts 115. After the base structure 400 is installed in the pre-excavation trench 200, the area outlined by the pre-excavation trench 200 can be excavated.

The method can also include disposing a hydraulic brace legs 130 onto each of the linear roller carts 120 disposed onto each of the plurality of linear slide-rail posts 110; securing a plurality of corner connections of the hydraulic brace legs 130, wherein each corner connection can form an approximate 90-degree angle therebetween; and securing a plurality of knee brace or crossing brace 135 connections, wherein each knee brace or crossing brace 135 can be disposed in a generally diagonal orientation proximate each hydraulic brace leg 130 corner connection. Moreover, for example, the method can include connecting a generally vertical linking tube 140 to each linear roller cart 120, wherein the linking tube 140 can be configured to vertically connect each linear roller cart 120 to an additional linear roller cart 120, and wherein the linking tube 140 can have a top end and a bottom end; connecting a generally vertical linking tube 140 to each corner linear roller cart 120, wherein the linking tube 140 can be configured to vertically connect each corner roller cart 125 to an additional corner roller cart 125, and wherein the linking tube 140 can have a top end and a bottom end.

In some embodiments, the method can also include installing at least one additional lower slide-rail panel 105, wherein the at least one additional lower slide-rail panel 105 can be installed behind the at least one slide-rail panel 105 in the base structure 400, wherein the at least one additional lower slide-rail panel 105 can have opposing first and second ends, wherein the first end can be disposed within a recessed groove 191 of the linear slide-rail post 110 and the second end can be disposed within one of the recessed grooves 150 of the corner slide-rail posts 115. In other embodiments, the method can include connecting an additional linear roller cart 120 to the top end of the linking tube 140, and connecting an additional corner roller cart 125 to the top end of the linking tube 140.

A method of excavating an area can include the following steps. A pre-excavation trench 200 having an inward facing side and an outer facing side can be dug using standard excavating equipment such as a backhoe or excavator. The pre-excavation trench 200 can outline a square, rectangular, hexagonal, or any other shape or geometric pattern any geometric shape. A base structure 400 is completed. Once the base structure 400 is completed, the area outlined by the pre-excavation trench 200 can be excavated. After the area is excavated, first linear roller carts 120 can be slideably inserted on linear slide-rail post 110 and first corner roller carts 125 can be slideably inserted on corner slide rail posts 115. Hydraulic brace legs 130 can then be connected to first linear roller carts 120 and first corner rail carts 120. Additional crossing braces 135 can also be connected to hydraulic brace legs 130. Linking tube 140 can be connected to the first linear roller cart 120 or first corner roller cart 125 at or near the bottom end, and secured at an aperture (not shown). The linking tube 140 can also be connected to a second roller cart 120 or second corner roller cart 125 at or near the top end, and secured at another aperture (not shown).

After the hydraulic brace legs 130 are connected to the first linear roller carts 120 and first corner roller carts 125, a second set of lower elongated panels (not shown) can be slideably positioned in the additional recessed groove or track 190, 191 that can function as track of the linear slide-rail post 110 or the additional recessed groove or track 150, 151 that can function as track of the corner slide rail posts 115. Hydraulic brace legs 130 can be connected to the second roller carts 120 and second corner rail carts 125. Additional crossing braces 135 can also be connected to the hydraulic brace legs 130.

After the hydraulic brace legs 130 are connected to the second roller carts 120 and second corner rail carts 125, one of the two lower elongated panels connected to the slide posts 110 and 115 can be forced further into the ground using any machinery capable of generating enough downward force such as a backhoe.

After the entire perimeter of one set of lower side rail panels 105 is lowered, the area inside is excavated again and the system of roller carts 120, corner roller carts 125, linear slide rail posts 110, corner slide rail posts 115, hydraulic brace legs 130 and crossing braces 135 can be lowered to the base of the excavated area. First upper side rail panels 106 can be slideably positioned in grove 190, 191 of the linear slide rail posts and groove 150, 151 corner slide rail posts 200 such that the first upper side rail panels 106 are in the same grove as the lower side rail panel that has not been forced further into the ground.

After the first upper side rail panels 106 are in place, the first upper side rail panel 106 and the lower side rail panel 105 can be forced further into the ground until the first lower side rail panels 105 and the second lower side rail panels 105 are at substantially the same depth. A second upper side rail panel 106 can be inserted in the grove 150, 151, 190, 191 that is not occupied by the first upper side rail panel 106. This process can be repeated until the depth of the excavated area is 3, 4, 5, or more panels deep.

The corner linear roller cart 120 and the corner roller cart 125 can provide for improved operator safety during the installation and removal of excavation support systems 100, such as slide-rail post trench shoring systems, because the interface between the operator and heavy equipment, such as the hydraulic brace legs 130 can be minimized during this process. Moreover, improvements in efficiency can be realized with a faster mechanical installation and removal process versus a manual process.

Embodiments of the present disclosure further relate to any one or more of the following paragraphs 1 to 20:

1. An excavation support system, comprising: a plurality of linear slide-rail posts, each linear slide-rail post having at least one recessed groove formed in a longitudinal axis thereof; a plurality of corner slide-rail posts, each corner slide-rail post having two substantially parallel recessed grooves formed in a longitudinal axis thereof, wherein the two substantially parallel recessed grooves define an angle therebetween; at least one slide-rail panel having opposing first and second ends, wherein the first end is disposed within the recessed groove of the linear slide-rail post and the second end is disposed within one of the recessed grooves of the corner slide-rail posts; at least one linear roller cart, having at least one roller attached thereto, adapted to slide onto the linear slide-rail post and secure thereto, the linear roller cart comprising a generally horizontal plate for supporting at least one hydraulic brace leg, wherein the linear roller cart is movable in an upward and downward direction relative to the vertical axis of the linear slide-rail post without interference from the slide-rail panel; and at least one corner roller cart having at least one roller attached thereto, adapted to slide onto the corner slide-rail post and secure thereto, the corner roller cart comprising a generally horizontal plate for supporting at least one hydraulic brace leg, wherein each corner roller cart is movable in an upward and downward direction relative to the vertical axis of the corner slide-rail post.

2. The excavation support system according to paragraph 1, wherein the linear roller cart comprises a generally vertical back plate having a front surface and a back surface, wherein the at least one roller is attached to the back plate, extending from the back surface thereof.

3. The excavation support system according to paragraphs 1 or 2, wherein the corner roller cart comprises a generally vertical back plate having a front surface and a back surface, wherein the at least one roller is attached to the back plate, extending from the back surface thereof.

4. The excavation support system according to any one or more paragraphs 1 to 3, wherein the two substantially parallel recessed grooves formed in the longitudinal axis of the corner slide-rail post define an approximate 90-degree angle therebetween.

5. The excavation support system according to any one or more paragraphs 1 to 4, wherein each linear slide-rail post further comprises an extended faceplate disposed along the longitudinal axis thereof.

6. The excavation support system according to any one or more paragraphs 1 to 5, wherein the corner slide-rail posts further comprise an extended faceplate disposed along the longitudinal axis thereof.

7. The excavation support system according to paragraph 5, wherein the corner roller cart further comprises a plurality of guide plates, wherein the guide plates are configured to slide onto and secure to the extended faceplate of the linear slide-rail post, and wherein the guide plates are configured to facilitate slideable movement of the corner slide cart in an upward and downward direction relative to the vertical axis of the linear slide-rail post.

8. The excavation system according to any one or more paragraphs 5 to 7, wherein the corner roller cart further comprises a plurality of guide plates, wherein the guide plates are configured to slide onto and secure to the extended faceplate of the corner slide-rail post, and wherein the guide posts are configured to facilitate slideable movement of the corner slide cart in an upward and downward direction relative to the vertical axis of the corner slide-rail post.

9. The excavation system according to any one or more paragraphs 1 to 8, wherein the corner roller cart further comprises a corner swivel brace, wherein the corner swivel braces comprises a generally vertical support configured to connect ends of two hydraulic brace legs, forming an angle therebetween.

10. The excavation system according to any one or more paragraphs 1 to 9, wherein the generally vertical support is a generally vertical teardrop support.

11. The excavation system according to any paragraph 9 to 10, wherein the angle between the two hydraulic brace legs is about 90-degrees.

12. The excavation system according to any one or more paragraphs 1 to 11, wherein the corner roller cart further comprises a linking tube, wherein the linking tube is configured to connect two corner roller carts to one another when vertically aligned.

13. The excavation system according to any one or more paragraphs 1 to 12, wherein the linear roller cart further comprises a linking tube, wherein the linking tube is configured to connect two linear roller carts to one another when vertically aligned.

14. A method for installing an excavation support system, comprising: assembling a base structure in a pre-excavation trench, wherein the base structure comprises: a plurality of linear slide-rail posts, each linear slide-rail post having at least one recessed groove formed in a longitudinal axis thereof; a plurality of corner slide-rail posts, each corner slide rail post having two substantially parallel recessed grooves formed in a longitudinal axis thereof, wherein the two substantially parallel recessed grooves define an angle therebetween; a plurality of slide-rail panels having opposing first and second ends, wherein the first end is disposed within one of the recessed grooves of the linear slide-rail posts and the second end is disposed within one of the recessed grooves of the corner slide-rail posts; disposing at least one linear roller cart, having at least one roller attached thereto, onto at least one of the plurality of linear slide-rail posts, wherein the at least one linear roller cart is adapted to slide onto the linear slide-rail post and secure thereto, the linear roller cart comprising a generally horizontal plate for supporting at least one hydraulic brace leg, wherein the linear roller cart is movable in an upward and downward direction relative to the vertical axis of the linear slide-rail; and disposing at least one corner roller cart, having at least one roller attached thereto, onto at least one of the plurality of corner slide-rail posts, wherein the at least one corner roller cart is adapted to slide onto the corner slide-rail post and secure thereto, the corner roller cart comprising a generally horizontal plate for supporting at least one hydraulic brace leg, wherein each corner roller cart is movable in an upward and downward direction relative to the vertical axis of the corner slide-rail post.

15. The method according to paragraph 14, further comprising disposing a wale beam onto each of the at least one linear roller carts disposed onto each of the plurality of linear slide-rail posts.

16. The method according to paragraph 14 or 15, further comprising securing a plurality of corner connections of the hydraulic brace legs, wherein each corner connection forms an approximate 90-degree angle.

17. The method according to any one or more paragraphs 14 to 16, further comprising securing a plurality of knee brace or crossing brace connections, wherein each knee brace or crossing brace is disposed in a generally diagonal orientation proximate each hydraulic brace leg corner connection.

18. The method according to any one or more paragraphs 14 to 17, further comprising connecting a generally vertical linking tube to each linear roller cart, wherein the linking tube is configured to vertically connect each linear roller cart to an additional linear roller cart, and wherein the linking tube has a top end and a bottom end.

19. The according to any one or more paragraphs 14 to 18, further comprising connecting a generally vertical linking tube to each corner roller cart, wherein the linking tube is configured to vertically connect each corner roller cart to an additional corner roller cart, and wherein the linking tube has a top end and a bottom end.

20. The method according to any one or more paragraphs 14 to 19, further comprising installing a second plurality of slide-rail panels.

Certain embodiments and features have been described using a set of numerical upper limits and a set of numerical lower limits. It should be appreciated that ranges including the combination of any two values, e.g., the combination of any lower value with any upper value, the combination of any two lower values, and/or the combination of any two upper values are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art.

Various terms have been defined above. To the extent a term used in a claim is not defined above, it should be given the broadest definition persons in the pertinent art have given that term as reflected in at least one printed publication or issued patent. Furthermore, all patents, patent application publications, test procedures, and other documents cited in this application are fully incorporated by reference herein to the extent such disclosure is not inconsistent with this application and for all jurisdictions in which such incorporation is permitted.

While the foregoing has been disclosed and described in preferred forms with a certain degree of particularity, it is understood that the present disclosure of the preferred forms is only by way of example and that numerous changes in the details of operation and in the combination and arrangement of parts may be resorted to without departing from the spirit and scope of the invention, which is defined by the claims that follow.

While the foregoing has been disclosed and described in preferred forms with a certain degree of particularity, it is understood that the present disclosure of the preferred forms is only by way of example and that numerous changes in the details of operation and in the combination and arrangement of parts may be resorted to without departing from the spirit and scope of the invention, which is defined by the claims that follow.

What is claimed is:

1. An excavation support system, comprising:

a plurality of linear slide-rail posts, each linear slide-rail post having at least one recessed groove formed in a longitudinal axis thereof;

a plurality of corner slide-rail posts, each corner slide-rail post having two substantially parallel recessed grooves formed in a longitudinal axis thereof, wherein the two substantially parallel recessed grooves define an angle therebetween;

at least one slide-rail panel having opposing first and second ends, wherein the first end is disposed within the recessed groove of the linear slide-rail post and the second end is disposed within one of the recessed grooves of the corner slide-rail posts;

at least one linear roller cart, having at least one roller attached thereto, adapted to slide onto the linear slide-rail post and secure thereto, the linear roller cart comprising a generally horizontal plate for supporting at least one hydraulic brace leg, wherein the linear roller cart is movable in an upward and downward direction relative to the vertical axis of the linear slide-rail post without interference from the slide-rail panel; and at least one corner roller cart having at least one roller attached thereto, adapted to slide onto the corner slide-rail post and secure thereto, the corner roller cart comprising a generally horizontal plate for supporting at least one hydraulic brace leg, wherein each corner roller cart is movable in an upward and downward direction relative to the vertical axis of the corner slide-rail post.

2. The excavation support system of claim 1, wherein the linear roller cart comprises a generally vertical back plate having a front surface and a back surface, wherein the at least one roller is attached to the back plate, extending from the back surface thereof.

3. The excavation support system of claim 1, wherein the corner roller cart comprises a generally vertical back plate having a front surface and a back surface, wherein the at least one roller is attached to the back plate, extending from the back surface thereof.

4. The excavation support system of claim 1, wherein the two substantially parallel recessed grooves formed in the longitudinal axis of the corner slide-rail post define an approximate 90-degree angle therebetween.

5. The excavation support system of claim 1, wherein each linear slide-rail post further comprises an extended faceplate disposed along the longitudinal axis thereof.

6. The excavation support system of claim 5, wherein the corner roller cart further comprises a plurality of guide plates, wherein the guide plates are configured to slide onto and secure to the extended faceplate of the linear slide-rail post, and wherein the guide plates are configured to facilitate slideable movement of the corner slide cart in an upward and downward direction relative to the vertical axis of the linear slide-rail post.

7. The excavation support system of claim 1, wherein the corner slide-rail posts further comprise an extended faceplate disposed along the longitudinal axis thereof.

8. The excavation system of claim 7, wherein the corner roller cart further comprises a plurality of guide plates, wherein the guide plates are configured to slide onto and secure to the extended faceplate of the corner slide-rail post, and wherein the guide posts are configured to facilitate slideable movement of the corner slide cart in an upward and downward direction relative to the vertical axis of the corner slide-rail post.

9. The excavation system of claim 1, wherein the corner roller cart further comprises a corner swivel brace, wherein the corner swivel braces comprises a generally vertical support configured to connect ends of two hydraulic brace legs, forming an angle therebetween.

10. The excavation system of claim 9, wherein the generally vertical support is a generally vertical teardrop support.

11. The excavation system of claim 9, wherein the angle between the two hydraulic brace legs is about 90-degrees.

12. The excavation system of claim 1, wherein the corner roller cart further comprises a linking tube, wherein the linking tube is configured to connect two corner roller carts to one another when vertically aligned.

13. The excavation system of claim 1, wherein the linear roller cart further comprises a linking tube, wherein the linking tube is configured to connect two linear roller carts to one another when vertically aligned.

14. A method for installing an excavation support system, comprising:

assembling a base structure in a pre-excavation trench, wherein the base structure comprises: a plurality of linear slide-rail posts, each linear slide-rail post having at least one recessed groove formed in a longitudinal axis thereof; a plurality of corner slide-rail posts, each corner slide rail post having two substantially parallel recessed grooves formed in a longitudinal axis thereof, wherein the two substantially parallel recessed grooves define an angle therebetween; a plurality of slide-rail panels having opposing first and second ends, wherein the first end is disposed within one of the recessed grooves of the linear slide-rail posts and the second end is disposed within one of the recessed grooves of the corner slide-rail posts;

disposing at least one linear roller cart, having at least one roller attached thereto, onto at least one of the plurality of linear slide-rail posts, wherein the at least one linear roller cart is adapted to slide onto the linear slide-rail post and secure thereto, the linear roller cart comprising a generally horizontal plate for supporting at least one hydraulic brace leg, wherein the linear roller cart is movable in an upward and downward direction relative to the vertical axis of the linear slide-rail; and disposing at least one corner roller cart, having at least one roller attached thereto, onto at least one of the plurality of corner slide-rail posts, wherein the at least one corner roller cart is adapted to slide onto the corner slide-rail post and secure thereto, the corner roller cart comprising a generally horizontal plate for supporting at least one hydraulic brace leg, wherein each corner roller cart is movable in an upward and downward direction relative to the vertical axis of the corner slide-rail post.

15. The method of claim 14, further comprising disposing a wale beam onto each of the at least one linear roller carts disposed onto each of the plurality of linear slide-rail posts.

16. The method of claim 15, further comprising securing a plurality of corner connections of the hydraulic brace legs, wherein each corner connection forms an approximate 90-degree angle.

17. The method of claim 16, further comprising securing a plurality of knee brace or crossing brace connections, wherein each knee brace or crossing brace is disposed in a generally diagonal orientation proximate each hydraulic brace leg corner connection.

18. The method of claim 17, further comprising connecting a generally vertical linking tube to each linear roller cart, wherein the linking tube is configured to vertically connect each linear roller cart to an additional linear roller cart, and wherein the linking tube has a top end and a bottom end.

19. The method of claim 17, further comprising connecting a generally vertical linking tube to each corner roller cart, wherein the linking tube is configured to vertically connect each corner roller cart to an additional corner roller cart, and wherein the linking tube has a top end and a bottom end.

20. The method of claim 17, further comprising installing a second plurality of slide-rail panels.

* * * * *